US010121439B2

(12) United States Patent
Kim et al.

(10) Patent No.: US 10,121,439 B2
(45) Date of Patent: Nov. 6, 2018

(54) DISPLAY DEVICE AND GATE DRIVING CIRCUIT

(71) Applicant: Samsung Display Co., Ltd., Yongin-si, Gyeonggi-do (KR)

(72) Inventors: Sunghwan Kim, Yongin-si (KR); Junhyun Park, Suwon-si (KR); Kyoungju Shin, Hwaseong-si (KR); Woongsik Choi, Ansan-si (KR)

(73) Assignee: Samsung Display Co., Ltd., Yongin-si (KR)

( * ) Notice: Subject to any disclaimer, the term of this patent is extended or adjusted under 35 U.S.C. 154(b) by 135 days.

(21) Appl. No.: 15/233,851

(22) Filed: Aug. 10, 2016

(65) Prior Publication Data

US 2017/0193947 A1 Jul. 6, 2017

(30) Foreign Application Priority Data

Jan. 4, 2016 (KR) ..... 10-2016-0000551

(51) Int. Cl.
*G09G 3/36* (2006.01)

(52) U.S. Cl.
CPC ... *G09G 3/3677* (2013.01); *G09G 2310/0286* (2013.01); *G09G 2310/0289* (2013.01); *G09G 2310/08* (2013.01)

(58) Field of Classification Search
CPC ... G09G 2310/0267; G09G 2310/0286; G09G 2310/0289; G09G 3/3674; G09G 3/3677
USPC ..... 345/100
See application file for complete search history.

(56) References Cited

U.S. PATENT DOCUMENTS

2013/0335665 A1 12/2013 Tseng et al.
2015/0042689 A1* 2/2015 Kim ..... H03K 3/012 345/690

FOREIGN PATENT DOCUMENTS

| | | | |
|---|---|---|---|
| JP | 2012-231462 | A | 11/2012 |
| KR | 10-0525740 | B1 | 11/2005 |
| KR | 10-2014-0042308 | A | 4/2014 |
| KR | 10-2015-0028403 | A | 3/2015 |

* cited by examiner

*Primary Examiner* — Roy P Rabindranath
(74) *Attorney, Agent, or Firm* — Lewis Roca Rothgerber Christie LLP

(57) ABSTRACT

A display device includes: a display panel; and a gate driving circuit, a kth driving stage from among driving stages for outputting a kth gate signal from among gate signals, where k is a natural number of two or more, including: at least one output transistor including a control electrode connected to a first node, an input electrode to receive a clock signal, and an output electrode to output an output signal; a first control transistor to output an activation signal to the first node before the kth gate signal is outputted; a capacitor to boost a voltage of the first node after the activation signal is provided to the first node; second and third control transistors connected in series between the first node and a voltage input terminal; and a first intermediate node between the second control transistor and the third control transistor for receiving the output signal.

20 Claims, 16 Drawing Sheets

DISPLAY DEVICE AND GATE DRIVING CIRCUIT

CROSS-REFERENCE TO RELATED APPLICATION

This application claims priority to and the benefit of Korean Patent Application No. 10-2016-0000551, under 35 U.S.C. § 119, filed on Jan. 4, 2016, in the Korean Intellectual Property Office (KIPO), the entire content of which is hereby incorporated by reference.

BACKGROUND

1. Field

One or more aspects of example embodiments of the present disclosure relate to a display device, and more particularly, to a display device including a gate driving circuit.

2. Description of the Related Art

A display device includes a plurality of gate lines, a plurality of data lines, and a plurality of pixels connected to the plurality of gate lines and the plurality of data lines, respectively. The display device includes a gate driving circuit for providing gate signals to the plurality of gate lines, and a data driving circuit for outputting data signals to the plurality of data lines.

The gate driving circuit includes a shift register including a plurality of driving circuits (hereinafter referred to as driving stages). The plurality of driving stages respectively output gate signals corresponding to the plurality of gate lines. Each of the plurality of driving stages includes a plurality of operatively-connected transistors.

The above information disclosed in this Background section is for enhancement of understanding of the background of the inventive concept, and therefore, it may contain information that does not constitute prior art.

SUMMARY

One or more aspects of example embodiments of the present disclosure are directed toward a display device including a gate driving circuit integrated on the display device.

One or more aspects of example embodiments of the present disclosure are directed toward a display device including a less-defective gate driving circuit.

According to an example embodiment of the inventive concept, a display device includes: a display panel including a plurality of gate lines; and a gate driving circuit including a plurality of driving stages configured to output a plurality of gate signals to the gate lines, a kth driving stage from among the plurality of driving stages for outputting a kth gate signal from among the plurality of gate signals, where k is a natural number of two or more, the kth driving stage including: at least one output transistor including a control electrode connected to a first node, an input electrode configured to receive a clock signal, and an output electrode configured to output an output signal; a first control transistor configured to output an activation signal to turn on the at least one output transistor to the first node before the kth gate signal is outputted; a capacitor configured to boost a voltage of the first node after the activation signal is provided to the first node; and second and third control transistors connected in series between the first node and a voltage input terminal configured to receive a discharge voltage, wherein a first intermediate node between the second control transistor and the third control transistor is configured to receive the output signal.

In an embodiment, the at least one output transistor may include a first output transistor configured to output the kth gate signal, and a second output transistor configured to output a kth carry signal synchronized with the kth gate signal; and the first intermediate node may be configured to receive one of the kth gate signal and the kth carry signal as the output signal.

In an embodiment, the capacitor may be connected between an output electrode of the first output transistor and a control electrode of the first output transistor.

In an embodiment, the second and third control transistors may be configured to be turned on in response to a k+1th output signal outputted from a k+1th driving stage from among the driving stages.

In an embodiment, the activation signal may be a k−1th output signal outputted from a k−1th driving stage from among the driving stages.

In an embodiment, the display device may further include fourth and fifth control transistors connected in series between the first node and the voltage input terminal, the fourth and fifth control transistors being configured to be turned on during a period different from the second and third control transistors, and a second intermediate node between the fourth control transistor and the fifth control transistor may be configured to receive the output signal.

In an embodiment, the display device may further include inverter transistors configured to provide a switching signal to a second node connected to control electrodes of the fourth and fifth control transistors, and the inverter transistors may include: at least one output inverter transistor configured to output the clock signal to the second node; and at least one pull-down inverter transistor configured to pull down a voltage of the second node during a period when the kth gate signal is outputted.

In an embodiment, the display device may further include a pull-down transistor configured to provide the discharge voltage to the output electrode of the at least one output transistor after the kth gate signal is outputted.

According to an example embodiment of the inventive concept, a display device includes: a display panel including a plurality of gate lines; and a gate driving circuit including a plurality of driving stages electrically connected to the gate lines, respectively, a kth driving stage, where k is a natural number of two or more, from among the driving stages comprising: an output unit configured to generate a kth output signal based on a clock signal, and to output the kth output signal to an output terminal in response to a voltage of a first node; a first control unit configured to control the voltage of the first node; a second control unit configured to output a switching signal to a second node, the switching signal being generated based on the clock signal; and a pull-down unit configured to pull down a voltage of the output terminal after the kth output signal is outputted. The first control unit includes: a first control transistor configured to provide an activation signal for activating the output unit to the first node before the kth output signal is outputted; and second and third control transistors connected in series between the first node and a first voltage input terminal configured to receive a first discharge voltage. The kth output signal is to be provided to a first intermediate node between the second control transistor and the third control transistor.

In an embodiment, the kth output signal may include a kth gate signal and a kth carry signal, and the output terminal includes a first output terminal and a second output terminal, and the output unit may include: a first output transistor including a control electrode connected to the first node, an input electrode configured to receive the clock signal, and an output electrode configured to output the kth gate signal to the first output terminal; a second output transistor including a control electrode connected to the first node, an input electrode configured to receive the clock signal, and an output electrode configured to output the kth carry signal to the second output terminal; and a capacitor connected between the output electrode of the first output transistor and the control electrode of the first output transistor.

In an embodiment, the pull-down unit may include: a first pull-down unit configured to pull down the first output terminal after the kth gate signal is outputted; and a second pull-down unit configured to pull down the second output terminal after the kth carry signal is outputted.

In an embodiment, the first pull-down unit may include first and second pull-down transistors connected in series between the first output terminal and a second voltage input terminal configured to receive a second discharge voltage having a different level than that of the first discharge voltage; and the kth output signal may be provided to a second intermediate node between the first pull-down transistor and the second pull-down transistor.

In an embodiment, the first pull-down unit may further include third and fourth pull-down transistors connected in series between the first output terminal and the second voltage input terminal, the third and fourth pull-down transistors being configured to be turned on in a different period from a period when the first and second pull-down transistors are turned on; and the kth output signal may be provided to a third intermediate node between the third pull-down transistor and the fourth pull-down transistor.

In an embodiment, the second pull-down unit may include first and second pull-down transistors connected in series between the first output terminal and the first voltage input terminal; and the kth output signal may be provided to a second intermediate node between the first pull-down transistor and the second pull-down transistor.

In an embodiment, the second pull-down unit may further include third and fourth pull-down transistors connected in series between the first output terminal and the first voltage input terminal, the third and fourth pull-down transistors being configured to be turned on in a different period from a period when the first and second pull-down transistors are turned on; and the kth output signal may be provided to a third intermediate node between the third pull-down transistor and the fourth pull-down transistor.

In an embodiment, the second and third control transistors may be configured to be turned on in response to a k+1th output signal outputted from a k+1th driving stage from among the driving stages.

In an embodiment, the activation signal may be a k−1th output signal outputted from a k−1th driving stage.

In an embodiment, the first control unit may further include fourth and fifth control transistors connected in series between the first node and the first voltage input terminal and configured to be turned on in a different period from a period when the second and third control transistors are turned on; and the kth output signal may be provided to a second intermediate node between the fourth control transistor and the fifth transistor.

In an embodiment, the fourth and fifth control transistors may be configured to be turned on by the switching signal after the kth output signal is outputted.

BRIEF DESCRIPTION OF THE FIGURES

The accompanying drawings are included to provide a further understanding of the inventive concept, and are incorporated in and constitute a part of this specification. The drawings illustrate exemplary embodiments of the inventive concept, and together with the description, serve to explain aspects and features of the inventive concept. In the drawings.

DETAILED DESCRIPTION

Figure 1:
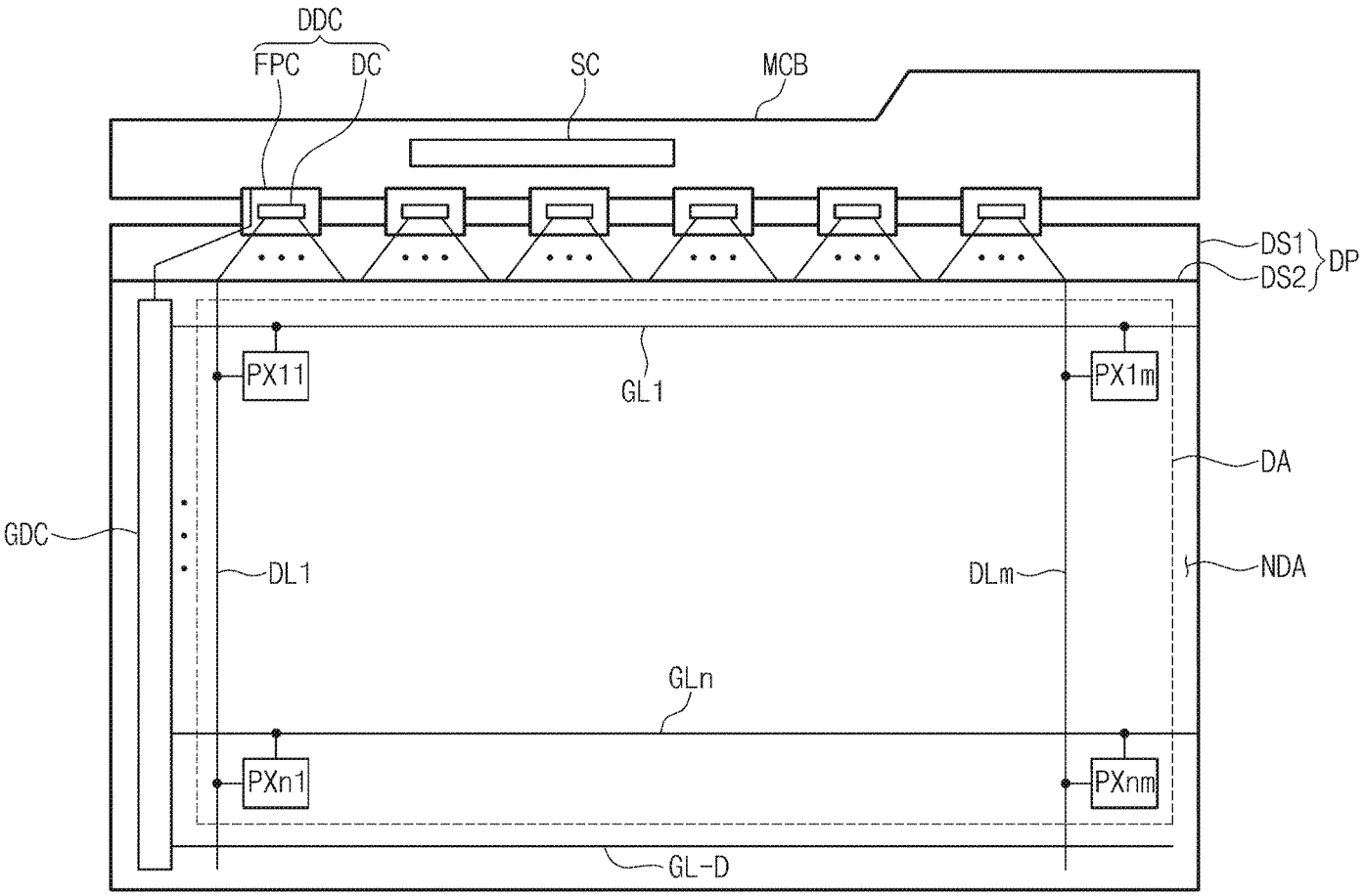
FIG. 1 is a plan view of a display device according to an embodiment of the inventive concept.

Hereinafter, example embodiments will be described in more detail with reference to the accompanying drawings. The present inventive concept, however, may be embodied in various different forms, and should not be construed as being limited to only the illustrated embodiments herein. Rather, these embodiments are provided as examples so that this disclosure will be thorough and complete, and will fully convey the aspects and features of the inventive concept to those skilled in the art. Accordingly, processes, elements, and techniques that are not necessary to those having ordinary skill in the art for a complete understanding of the aspects and features of the inventive concept may not be described. Unless otherwise noted, like reference numerals denote like elements throughout the attached drawings and the written description, and thus, descriptions thereof may not be repeated.

In the drawings, the relative sizes of elements, layers, and regions may be exaggerated and/or simplified for clarity. Spatially relative terms, such as "beneath," "below," "lower," "under," "above," "upper," and the like, may be used herein for ease of explanation to describe one element or feature's relationship to another element(s) or feature(s) as illustrated in the figures. It will be understood that the spatially relative terms are intended to encompass different orientations of the device in use or in operation, in addition to the orientation depicted in the figures. For example, if the device in the figures is turned over, elements described as "below" or "beneath" or "under" other elements or features would then be oriented "above" the other elements or features. Thus, the example terms "below" and "under" can encompass both an orientation of above and below. The device may be otherwise oriented (e.g., rotated 90 degrees or at other orientations) and the spatially relative descriptors used herein should be interpreted accordingly.

It will be understood that, although the terms "first," "second," "third," etc., may be used herein to describe various elements, components, regions, layers and/or sections, these elements, components, regions, layers and/or sections should not be limited by these terms. These terms are used to distinguish one element, component, region, layer or section from another element, component, region, layer or section. Thus, a first element, component, region, layer or section described below could be termed a second element, component, region, layer or section, without departing from the spirit and scope of the inventive concept.

It will be understood that when an element or layer is referred to as being "on," "connected to," or "coupled to" another element or layer, it can be directly on, connected to, or coupled to the other element or layer, or one or more intervening elements or layers may be present. In addition, it will also be understood that when an element or layer is referred to as being "between" two elements or layers, it can be the only element or layer between the two elements or layers, or one or more intervening elements or layers may also be present.

The terminology used herein is for the purpose of describing particular embodiments and is not intended to be limiting of the inventive concept. As used herein, the singular forms "a" and "an" are intended to include the plural forms as well, unless the context clearly indicates otherwise. It will be further understood that the terms "comprises," "comprising," "includes," and "including," when used in this specification, specify the presence of the stated features, integers, steps, operations, elements, and/or components, but do not preclude the presence or addition of one or more other features, integers, steps, operations, elements, components, and/or groups thereof. As used herein, the term "and/or" includes any and all combinations of one or more of the associated listed items. Expressions such as "at least one of," when preceding a list of elements, modify the entire list of elements and do not modify the individual elements of the list.

As used herein, the term "substantially," "about," and similar terms are used as terms of approximation and not as terms of degree, and are intended to account for the inherent variations in measured or calculated values that would be recognized by those of ordinary skill in the art. Further, the use of "may" when describing embodiments of the inventive concept refers to "one or more embodiments of the inventive concept." As used herein, the terms "use," "using," and "used" may be considered synonymous with the terms "utilize," "utilizing," and "utilized," respectively. Also, the term "exemplary" is intended to refer to an example or illustration.

Unless otherwise defined, all terms (including technical and scientific terms) used herein have the same meaning as commonly understood by one of ordinary skill in the art to which the present inventive concept belongs. It will be further understood that terms, such as those defined in commonly used dictionaries, should be interpreted as having a meaning that is consistent with their meaning in the context of the relevant art and/or the present specification, and should not be interpreted in an idealized or overly formal sense, unless expressly so defined herein.

Figure 2:
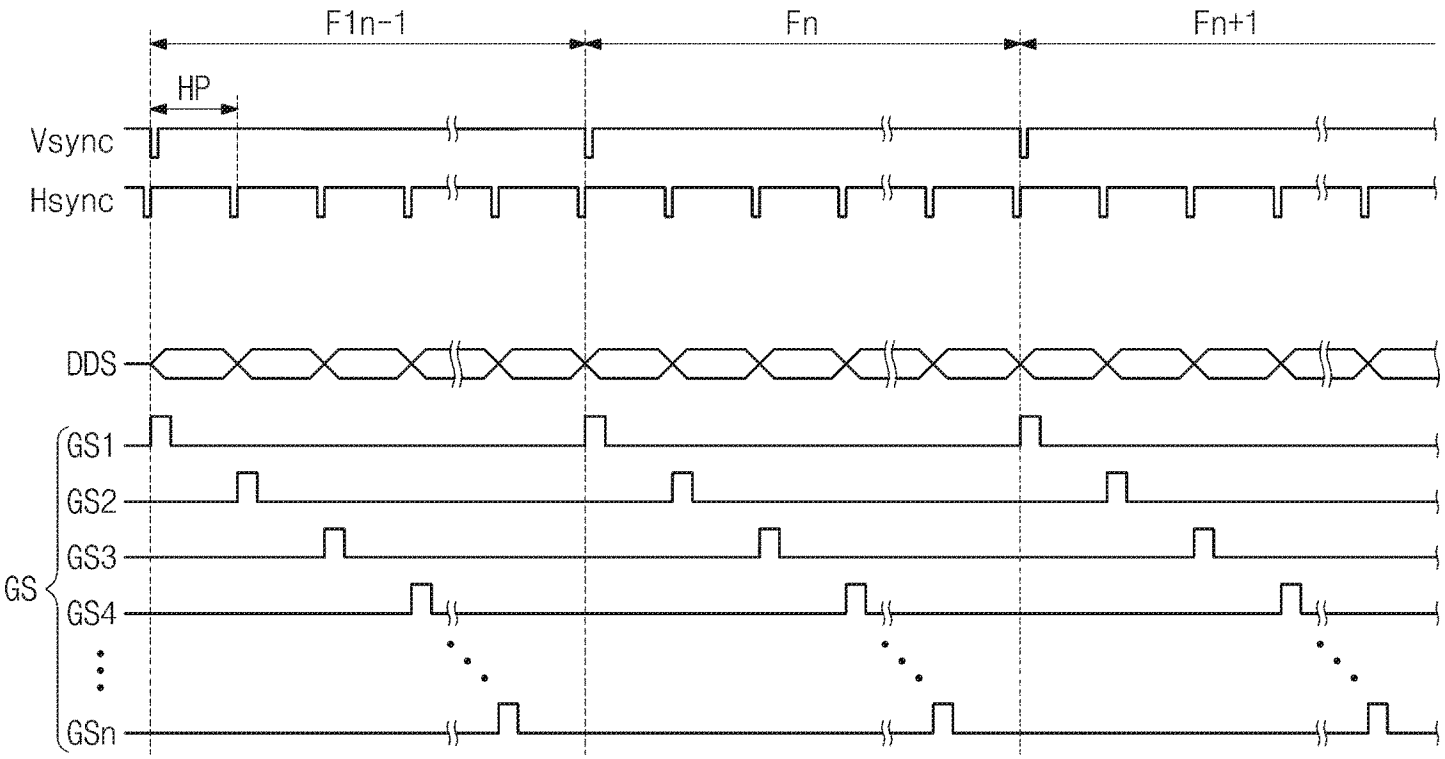
FIG. 2 is a timing diagram illustrating signals of a display device according to an embodiment of the inventive concept.

FIG. 1 is a plan view of a display device according to an embodiment of the inventive concept. FIG. 2 is a timing diagram illustrating signals of a display device according to an embodiment of the inventive concept.

As shown in FIGS. 1 and 2, a display device according to an embodiment of the inventive concept includes a display panel DP, a gate driving circuit GDC, and a data driving circuit DDC. Although one gate driving circuit GDC and six data driving circuits DDC are shown exemplarily, the inventive concept is not limited thereto.

The display panel DP is not particularly limited, and may include various display panels, such as a liquid crystal display panel, an organic light emitting display panel, an electrophoretic display panel, and/or an electrowetting display panel. For convenience, the display panel DP is described here as a liquid crystal display panel. When the display panel DP is a liquid crystal display panel, a liquid crystal display device including the liquid crystal display panel may further include a polarizer and a backlight unit (e.g., a backlight or a backlight source).

The display panel DP includes a first display substrate DS1, a second display substrate DS2 spaced from the first display substrate DS1, and a liquid crystal layer LCL (e.g., see FIG. 4) disposed between the first display substrate DS1 and the second display substrate DS2. On a plane, the display panel DP includes a display area DA including a plurality of pixels PX11 to PXnm, and a non-display area NDA surrounding the display area DA.

The first display substrate DS1 includes a plurality of gate lines GL1 to GLn and a plurality of data lines DL1 to DLm crossing the plurality of gate lines GL1 to GLn. The plurality of gate lines GL1 to GLn are connected to the gate driving circuit GDC. The plurality of data lines DL1 to DLm are connected to the data driving circuit DDC. For convenience, only some of the plurality of gate lines GL1 to GLn and only some of the plurality of data lines DL1 to DLm are illustrated in FIG. 1. Additionally, the first display substrate DS1 may include a dummy gate line GL-D disposed in the non-display area NDA. However, the inventive concept is not limited thereto, and according to an embodiment of the inventive concept, the dummy gate line GL-D may be omitted.

For convenience, only some of the plurality of pixels PX11 to PXnm are illustrated in FIG. 1. The plurality of pixels PX11 to PXnm are respectively connected to corresponding gate lines from among the plurality of gate lines GL1 to GLn and corresponding data lines from among the plurality of data lines DL1 to DLm. However, the dummy gate line GL-D is not connected to the plurality of pixels PX11 to PXnm.

The plurality of pixels PX11 to PXnm may be divided into a plurality of groups according to a color to be displayed. The plurality of pixels PX11 to PXnm may display any one of primary colors. The primary colors may include red, green, blue, and/or white. However, the inventive concept is not limited thereto, and thus, the primary colors may further include (or alternatively include) various colors, such as yellow, cyan, magenta, etc.

As shown in FIGS. 1 and 2, the gate driving circuit GDC and the data driving circuit DDC receive a control signal from a first signal control unit SC (e.g., a first controller, for example, a timing controller). The first signal control unit may be mounted on the main circuit board MCB. The first signal control unit receives image data and control signals from an external first graphic control unit (e.g., a first graphic controller). The control signals may include vertical sync signals Vsync that are signals for distinguishing frame periods Fn−1, Fn, and Fn+1, horizontal sync signals Hsync that are signals for distinguishing horizontal periods HP (e.g., row distinction signals), data enable signals (that may be in high level only during a period where data is outputted to display a data incoming area), and clock signals.

The gate driving circuit GDC generates gate signals GS1 to GSn on the basis of a control signal received from the first signal control unit SC during frame periods Fn−1, Fn, and Fn+1, and outputs the gate signals GS1 to GSn to the plurality of gate lines GL1 to GLn. The gate signals GS1 to GSn may be sequentially outputted in correspondence to the horizontal periods HP. The gate driving circuit GDC and the pixels PX11 to PXnm may be formed concurrently (e.g., simultaneously) through a thin film process. For example, the gate driving circuit GDC may be mounted in an Amorphous Silicon TFT Gate driver circuit (ASG) form or an Oxide Semiconductor TFT Gate driver circuit (OSG) form at (e.g., in) the non-display area NDA.

FIG. 1 illustrates one gate driving circuit GDC connected to the left ends of the plurality of gate lines GL1 to GLn. However the inventive concept is not limited thereto, and according to an embodiment of the inventive concept, a display device may include two gate driving circuits. One of the two gate driving circuits may be connected to the left ends of the plurality of gate lines GL1 to GLn and the other one of the two may be connected to the right ends of the plurality of gate lines GL1 to GLn. Further, or alternately, one of the two gate driving circuits may be connected to odd gate lines and the other one of the two may be connected to even gate lines.

As shown in FIGS. 1 and 2, the data driving circuit DDC generates gray level voltages according to image data provided from the first signal control unit SC on the basis of a control signal received from the first signal control unit SC. The data driving circuit DDC outputs the gray level voltages as data signals DDS to the plurality of data lines DL1 to DLm.

The data signals DDS may include positive voltages each having a positive value with respect to a common voltage, and/or negative voltages each having a negative value with respect to the common voltage. Some of data signals applied to the data lines DL1 to DLm may each have a positive polarity and others may each have a negative polarity during each of the horizontal periods HP. The polarity of the data signals DDS may be inverted according to the frame periods Fn−1, Fn, and Fn+1, in order to prevent or reduce the deterioration of liquid crystals. The data driving circuit DDC may generate data signals inverted by each frame period unit in response to an invert signal.

The data driving circuit DDC may include a driving chip DC and a flexible circuit board FPC on which the driving chip DC is mounted. The flexible circuit board FPC connects (e.g., electrically connects) the main circuit board MCB and the first display substrate DS1 to each other. The plurality of driving chips DC provide data signals to corresponding data lines from among the plurality of data lines DL1 to DLm.

FIG. 1 illustrates a Tape Carrier Package (TCP) type (form) data driving circuit DDC exemplarily. However, the inventive concept is not limited thereto, for example, according to an embodiment of the inventive concept, the data driving circuit DDC may be disposed at (e.g., in) the non-display area NDA of the first display substrate DS1 through a Chip on Glass (COG) method.

Figure 3:
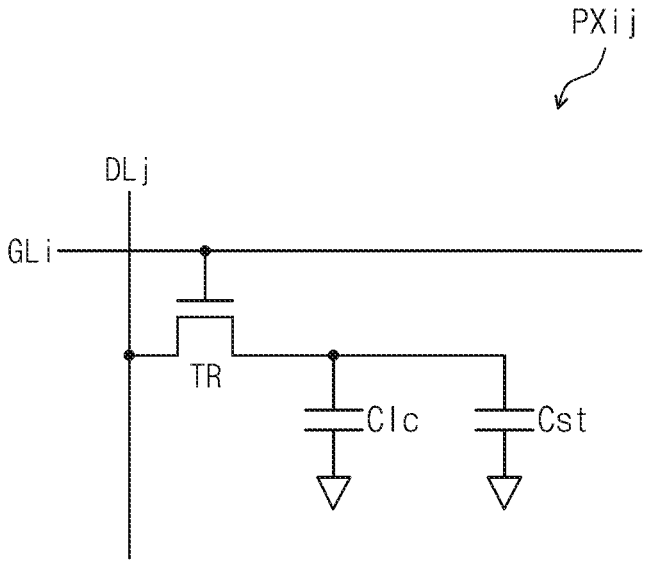
FIG. 3 is an equivalent circuit diagram of a pixel according to an embodiment of the inventive concept.
Figure 4:
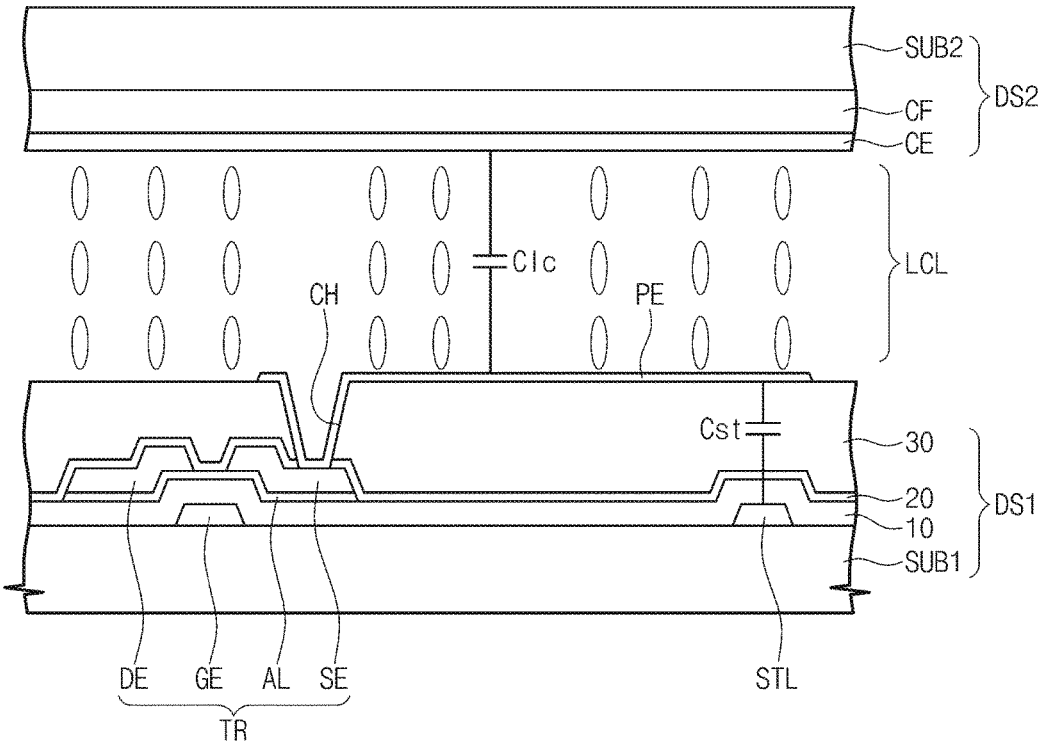
FIG. 4 is a sectional view of a pixel of a display panel according to an embodiment of the inventive concept.

FIG. 3 is an equivalent circuit diagram of a pixel PXij according to an embodiment of the inventive concept. FIG. 4 is a sectional view of a pixel PXij in a display panel DP according to an embodiment of the inventive concept. Each of the plurality of pixels PX11 to PXnm shown in FIG. 1 may have the same or substantially the same circuit as that shown in FIG. 3.

As shown in FIG. 3, the pixel PXij includes a pixel thin film transistor (hereinafter referred to as a pixel transistor) TR, a liquid crystal capacitor Clc, and a storage capacitor Cst. Hereinafter, a transistor refers to a thin film transistor. According to an embodiment of the inventive concept, the storage capacitor Cst may be omitted.

The pixel transistor TR is electrically connected to an ith gate line GLi and a jth data line DLj. The pixel transistor TR outputs a pixel voltage corresponding to a data signal received from the jth data line DLj in response to a gate signal received from the ith gate line GLi.

The liquid crystal capacitor Clc is charged with the pixel voltage outputted from the pixel transistor TR. An arrangement of liquid crystal directors included in the liquid crystal layer LCL (see FIG. 4) is changed according to a charge amount charged in the liquid crystal capacitor Clc. The light incident to the liquid crystal layer may be transmitted or blocked according to an arrangement of the liquid crystal directors.

The storage capacitor Cst is connected in parallel to the liquid crystal capacitor Clc. The storage capacitor Cst maintains or substantially maintains an arrangement of the liquid crystal directors during a set or predetermined period.

As shown in FIG. 4, the pixel transistor TR is disposed on a first base substrate SUB1. The pixel transistor TR includes a control electrode GE connected to the ith gate line GLi (see FIG. 3), an activation part AL overlapping with the control electrode GE, an input electrode DE connected to the jth data line DLj (see FIG. 3), and an output electrode SE spaced from the input electrode DE.

The liquid crystal capacitor Clc includes a pixel electrode PE and a common electrode CE. The storage capacitor Cst includes the pixel electrode PE and a portion of a storage line STL overlapping with the pixel electrode PE.

The ith gate line GLi and the storage line STL are disposed on a surface (e.g., one surface) of the first base substrate SUB1. The control electrode GE is branched from the ith gate line GLi. The ith gate line GLi and the storage line STL may include a metal (for example, Al, Ag, Cu, Mo, Cr, Ta, Ti, etc.) or an alloy thereof. The ith gate line GLi and the storage line STL may have a multi-layer structure, and for example, may include a Ti layer and a Cu layer.

A first insulating layer 10 covering the control electrode GE and the storage line STL is disposed on a surface (e.g., one surface) of the first base substrate SUB1. The first insulating layer 10 may include at least one of an inorganic material and an organic material. The first insulating layer 10 may be an organic layer or an inorganic layer. The first insulating layer 10 may have a multi-layer structure, and for example, may include a silicon nitride layer and a silicon oxide layer.

The activation part AL overlapping with the control electrode GE is disposed on the first insulating layer 10. The activation part AL may include a semiconductor layer and an ohmic contact layer. The semiconductor layer may include silicon. The semiconductor layer may include amorphous silicon or poly silicon. The semiconductor layer is disposed on the first insulating layer 10, and the ohmic contact layer is disposed on the semiconductor layer. The ohmic contract layer may include a dopant doped with higher density than that of the semiconductor layer.

According to an embodiment of the inventive concept, the activation part AL may include a metal oxide semiconductor layer. The metal oxide semiconductor layer may include Indium Tin Oxide (ITO), Indium Gallium Zinc Oxide (IGZO), and Zinc Oxide (ZnO). The materials may be amorphous.

The input electrode DE and the output electrode SE are disposed on the activation part AL. The input electrode DE and the output electrode SE are spaced from each other. Each of the input electrode DE and the output electrode SE partially overlaps with the control electrode GE.

A second insulating layer 20 covering the activation part AL, the output electrode SE, and the input electrode DE is disposed on the first insulating layer 10. The second insulating layer 20 may include at least one of an inorganic material and an organic material. The second insulating layer 20 may be an organic and/or inorganic layer. The second insulating layer 20 may have a multi-layer structure, and for example, may include a silicon nitride layer and a silicon oxide layer.

Although the pixel transistor TR having a staggered structure is shown in FIG. 1 exemplarily, a structure of the pixel transistor TR is not limited thereto. For example, the pixel transistor TR may have a planar structure.

A third insulating layer 30 is disposed on the second insulating layer 20. The third insulating layer 30 provides a flat surface. The third insulating layer 30 may include an organic material.

The pixel electrode PE is disposed on the third insulating layer 30. The pixel electrode PE is connected to the output electrode SE through a contact hole CH penetrating through the second insulating layer 20 and the third insulating layer 30. The pixel electrode PE may include a transparent conductive oxide. An alignment layer covering the pixel electrode PE may be disposed on the third insulating layer 30.

A second display substrate DS2 may include a second base substrate SUB2 and a color filter layer CF disposed on (e.g., under) a surface (e.g., one surface) of the second base substrate SUB2. A common electrode CE is disposed on (e.g., under) the color filter layer CF. A common voltage is applied to the common electrode CE. The common voltage and the pixel voltage may have different values. An alignment layer covering the common electrode CE may be disposed on (e.g., under) the common electrode CE. Another insulating layer may be disposed between the color filter layer CF and the common electrode CE.

The pixel electrode PE and the common electrode CE with the liquid crystal layer LCL therebetween form the liquid crystal capacitor Clc. Additionally, portions of the pixel electrode PE and the storage line STL, which are disposed with the first insulating layer 10, the second insulating layer 20, and the third insulating layer 30 therebetween, form the storage capacitor Cst. The storage line STL receives a storage voltage having a different value than that of a pixel voltage. The storage voltage may have a value that is the same as or different from that of the common voltage.

On the other hand, a section of the pixel PXij shown in FIG. 3 is just one example. For example, unlike those of FIG. 3, at least one of the color filter layer CF and the common electrode CE may be disposed on the first display substrate DS1. That is, a liquid crystal display panel according to an embodiment of the inventive concept may include a pixel in a Vertical Alignment (VA) mode, a Patterned Vertical Alignment (PVA) mode, an in-plane switching (IPS) mode, a fringe-field switching (FFS) mode, or a Plane to Line Switching (PLS) mode.

Figure 5:
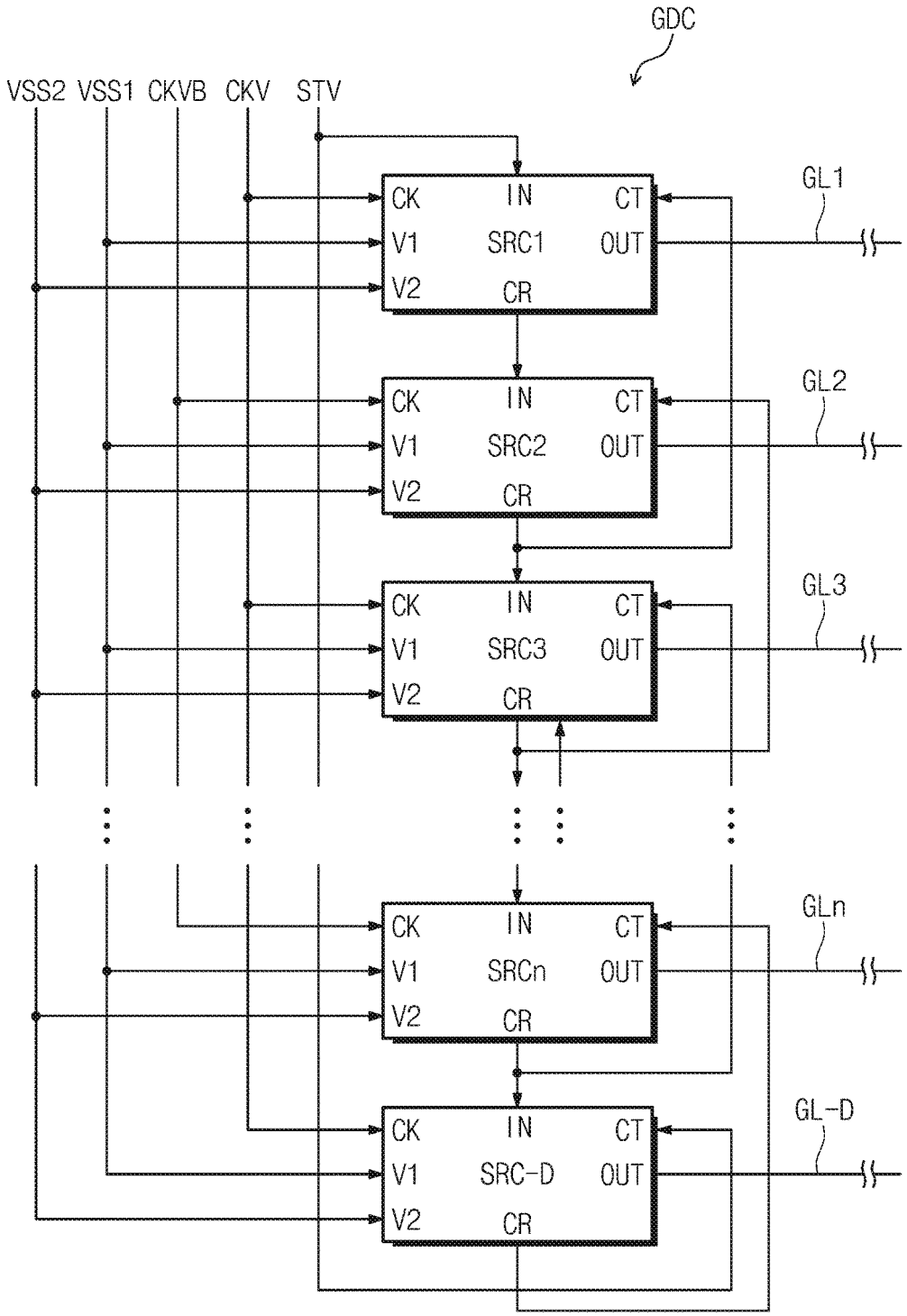
FIG. 5 is a block diagram illustrating a gate driving circuit according to an embodiment of the inventive concept.

FIG. 5 is a block diagram illustrating a gate driving circuit GDC according to an embodiment of the inventive concept. As shown in FIG. 5, the gate driving circuit GDC includes a plurality of driving stages SRC1 to SRCn. The plurality of driving stages SRC1 to SRCn are connected in cascade to each other.

According to an embodiment of the inventive concept, the plurality of driving stages SRC1 to SRCn are respectively connected to the plurality of gate lines GL1 to GLn. The plurality of driving stages SRC1 to SRCn respectively provide gate signals to the plurality of gate lines GL1 to GLn. The gate driving circuit GDC may further include a dummy stage SRC-D connected to a last driving stage SRCn from among the plurality of driving stages SRC1 to SRCn. The dummy stage SRC-D may be connected to the dummy gate line GL-D.

Each of the plurality of driving stages SRC1 to SRCn includes an output terminal OUT, a carry terminal CR, an input terminal IN, a control terminal CT, a clock terminal CK, a first voltage input terminal V1, and a second voltage input terminal V2.

The output terminal OUT of each of the plurality of driving stages SRC1 to SRCn is connected to a corresponding gate line from among the plurality of gate lines GL1 to GLn. Gate signals generated from the plurality of driving stages SRC1 to SRCn are provided to the plurality of gate lines GL1 to GLn, respectively, through the corresponding output terminal OUT.

The carry terminal CR of each of the driving stages SRC1 to SRCn is electrically connected to the input terminal IN of a next driving stage of a corresponding driving stage. The carry terminal CR of each of the plurality of driving stages SRC1 to SRCn outputs a carry signal.

The input terminal IN of each of the plurality of driving stages SRC2 to SRCn, other than the first driving stage SRC1, receives a carry signal of a previous driving stage of a corresponding driving stage. For example, the input terminal IN of the third driving stage SRC3 receives the carry signal of the second driving stage SRC2, that is an immediately previous driving stage. The input terminal IN of the first driving stage SRC1 from among the plurality of driving stages SRC1 to SRCn receives a start signal SW for starting the driving of the gate driving circuit GDC, instead of a carry signal of a previous driving stage.

The control terminal CT of each of the driving stages SRC1 to SRCn is electrically connected to the carry terminal CR of the next driving stage of a corresponding driving stage. The control terminal CT of each of the plurality of driving stages SRC1 to SRCn receives the carry signal of the next driving stage of a corresponding driving stage. For example, the control terminal CT of the second driving stage SRC2 receives a carry signal outputted from the carry terminal CR of the third driving stage SRC3, that is the immediately next driving stage of the second driving stage SRC2. However, the inventive concept is not limited thereto, and according to an embodiment of the inventive concept, the control terminal CT of each of the plurality of driving stages SRC1 to SRCn may be electrically connected to the output terminal OUT of the next driving stage of a corresponding driving stage.

The control terminal CT of the driving stage SRCn disposed at the end (e.g., a last driving stage) receives a carry signal outputted from the carry terminal CR of the dummy stage SRC-D. The control terminal CT of the dummy stage SRC-D receives the start signal STV.

The clock terminal CK of each of the plurality of driving stages SRC1 to SRCn receives one of a first clock signal CKV and a second clock signal CKVB. For example, each of the clock terminals CK of odd numbered driving stages (e.g., SRC1 and SRC3) from among the plurality of driving stages SRC1 to SRCn may receive the first clock signal CKV, and each of the clock terminals CK of even numbered driving stages (e.g., SRC2 and SRCn) from among the plurality of driving stages SRC1 to SRCn may receive the second clock signal CKVB. The first clock signal CKV and the second clock signal CKVB may have different phases from each other. For example, the second clock signal CKVB may be a signal obtained by inverting or delaying a phase of the first clock signal CKV.

The first voltage input terminal V1 of each of the plurality of driving stages SRC1 to SRCn receives a first discharge voltage VSS1. For example, the first discharge voltage VSS1 may be about −7 V to about −7.5 V. The second voltage input terminal V2 of each of the plurality of driving stages SRC1 to SRCn receives a second discharge voltage VSS2. The second discharge voltage VSS2 and the first discharge voltage VSS1 may have different levels. For example, the second discharge voltage VSS2 may have a lower level than that of the first discharge voltage VSS1. For example, the second discharge voltage VSS2 may be about −10V to about −11.5V.

According to an embodiment of the present disclosure, depending on a circuit configuration, each of the plurality of driving stages SRC1 to SRCn may omit one of the output terminal OUT, the input terminal IN, the carry terminal CR, the control terminal CT, the clock terminal CK, the first voltage input terminal V1, and the second voltage input terminal V2, or may further include other terminals. For example, the carry terminal CR may be omitted and/or one of the first voltage input terminal V1 and the second voltage input terminal V2 may be omitted. Additionally, the connection relationship of the plurality of driving stages SRC1 to SRCn may be variously changed.

Figure 6A:
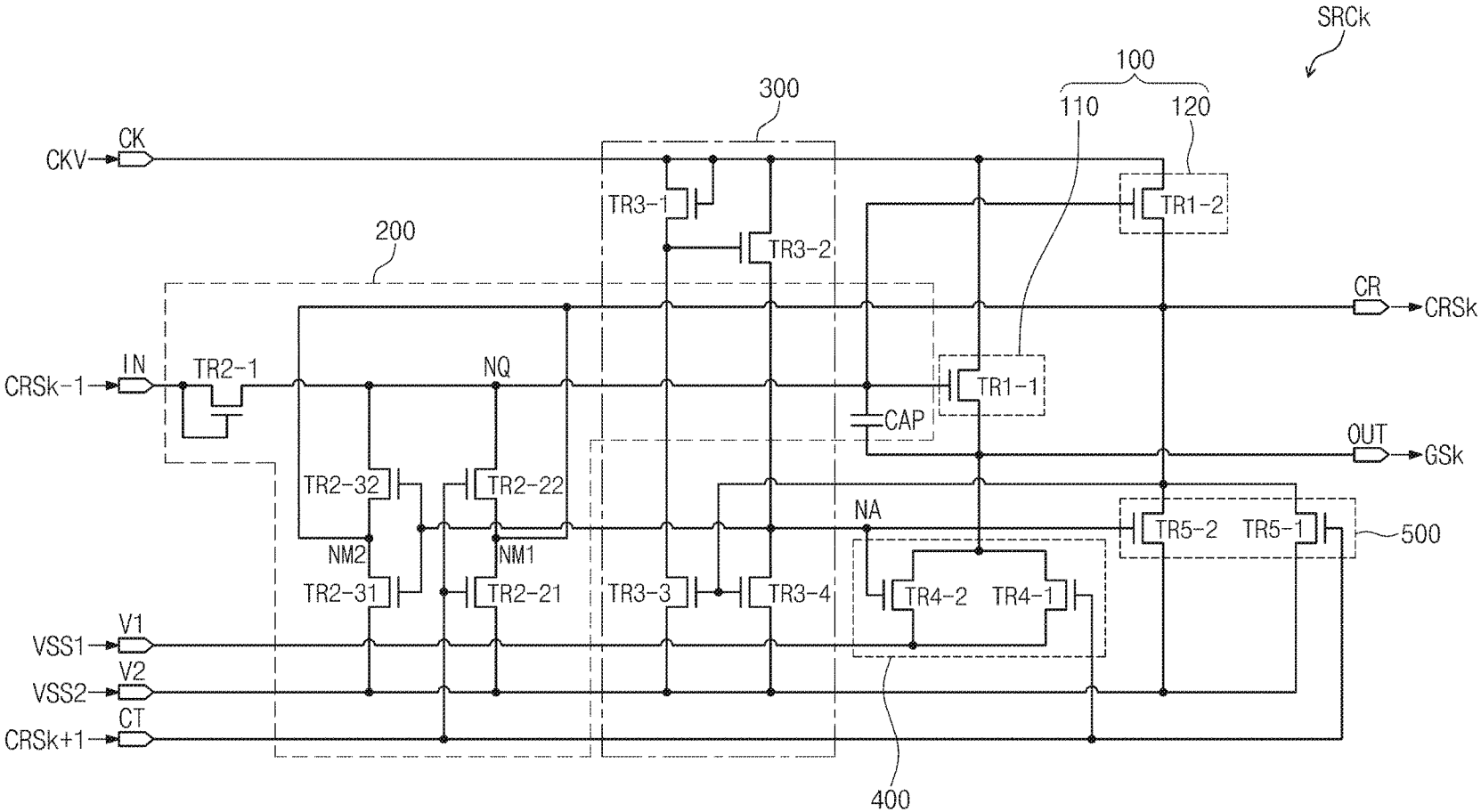
FIG. 6A is a circuit diagram of a driving stage according to an embodiment of the inventive concept.
Figure 6B:
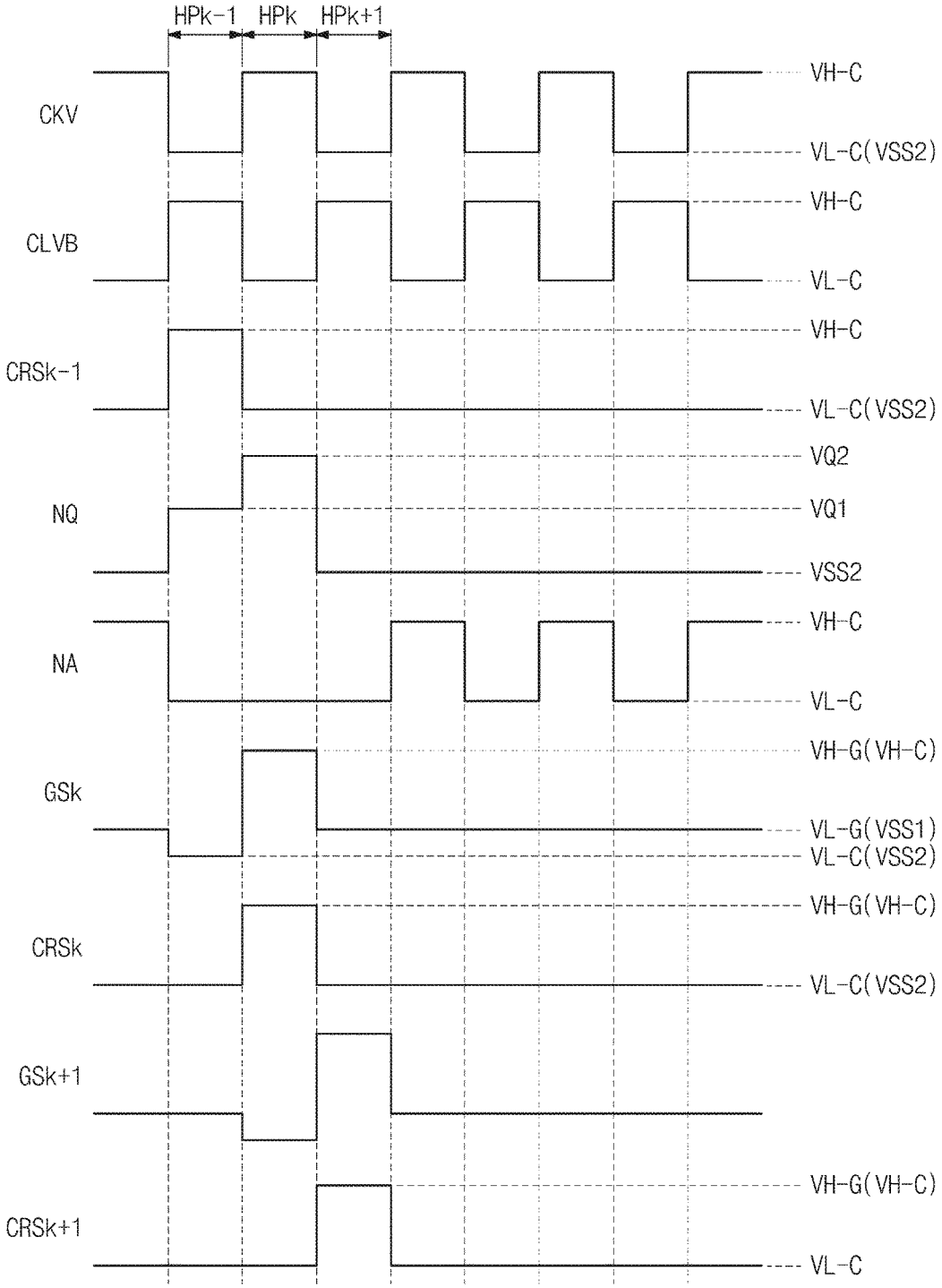
FIG. 6B is a signal waveform diagram of a driving stage shown in FIG. 6A.

FIG. 6A is a circuit diagram of a driving stage SRCk according to an embodiment of the inventive concept. FIG. 6B is a signal waveform diagram of a driving stage SRCk shown in FIG. 6A. Although FIG. 6B illustrates input/output signals as square waves for convenience, the input/output signals may be variously modified, for example, by external factors such as RC delay.

FIG. 6A illustrates a kth driving stage SRCk from among the plurality of n driving stages SRC1 to SRCn shown in FIG. 5. Each of the plurality of driving stages SRC1 to SRCn shown in FIG. 5 may have the same or substantially the same circuit structure as that of the kth driving stage SRCk.

Referring to FIGS. 6A and 6B, the kth driving stage SRCk includes an output unit 100, a first control unit 200, a second control unit 300, a first pull-down unit 400, and a second pull-down unit 500. The circuit structure of the kth driving stage is just exemplary and may be variously changed.

The output unit 100 is activated in response to a voltage of a first node NQ, and the activated output unit 100 outputs output signals GSk and CRSk. The output unit 100 is turned on/off according to a voltage level of the first node NQ. The first control unit 200 controls a voltage of the first node NQ. The second control unit 300 outputs an invert signal, which is generated based on the clock signal CKV, to a second node NA. After the output signals GSk and CRSk are outputted, the first pull-down unit 400 pulls down a voltage of the output terminal OUT. After the output signals GSk and CRSk are outputted, the second pull-down unit 500 pulls down a voltage of the carry terminal CR. However, the inventive concept is not limited thereto, and in an embodiment, one of the first pull-down unit 400 and the second pull-down unit 500 may be omitted.

Referring to FIGS. 6A and 6B, the output signals GSk and CRSk may include a kth gate signal GSk and a kth carry signal CRSk, which are generated based on the clock signal CKV. The output unit 100 includes a first output unit 110 for outputting the kth gate signal GSk, and a second output unit 120 for outputting the kth carry signal CRSk. The kth carry signal CRSk may be a signal synchronized with the kth gate signal GSk. The term "synchronized with" refers to two signals having a high voltage level during the same or substantially the same period. However, the high voltage levels of the two signals may not need to be the same.

The first output unit 110 includes a first output transistor TR1-1. The first output transistor TR1-1 includes a control electrode connected to the first node NQ, an input electrode for receiving a first clock signal CKV, and an output electrode for outputting a kth gate signal GSk. The second output unit 120 includes a second output transistor TR1-2. The second output transistor TR1-2 includes a control electrode connected to the first node NQ, an input electrode for receiving a first clock signal CKV, and an output electrode for outputting a kth carry signal CRSk.

As shown in FIG. 6B, the first clock signal CKV and the second clock signal CKVB may be signals with an inverted phase from each other. For example, the first clock signal CKV and the second clock signal CKVB may have a phase difference of 180°. Each of the first clock signal CKV and the second clock signal CKVB includes low periods VL-C (or a low voltage) having a relatively low level and high periods VH-C (or a high voltage) having a relatively high level. Each of the first clock signal CKV and the second clock signal CKVB may include alternating low periods and high periods. The high voltage VH-C may be, for example, about 14 V to about 15 V. The low voltage VL-C, for example, may have a level corresponding to the second discharge voltage VSS2.

The kth gate signal GSk includes a low period having a relatively low level and a high period having a relatively high level. The kth gate signal GSk may have a low voltage VL-G during a low period and a high voltage VH-G during a high period. The low voltage VL-G of the kth gate signal GSk may have a level, for example, corresponding to the first discharge voltage VSS1. The low voltage VL-G may be, for example, about −7.0 V to about −7.5 V. The kth gate signal GSk may have a level corresponding to the low voltage VL-C of the first clock signal CKV during some periods (for example, the HPk−1 period of FIG. 6B). The high voltage VH-G of the kth gate signal GSk may have a level corresponding to the high voltage VH-C of the first clock signal CKV. This will be described in more detail later.

The kth gate signal CRSk includes a low period having a relatively low level and a high period having a relatively high level. Because the kth carry signal CRSk is generated based on the first clock signal CKV, it has a similar or same low and high voltage levels to those of the first clock signal CKV.

Referring to FIGS. 6A and 6B, the first control unit 200 controls a voltage of the first node NQ. The first control unit 200 provides an activation signal to the first node NQ, and provides a discharge voltage VSS2 to the first node NQ.

In the present embodiment, the activation signal may be a k−1th carry signal CRSk−1 outputted from a k−1th driving stage SRCk−1. The first control unit 200 provides the second discharge voltage VSS2 to the first node NQ in response to a k+1th carry signal CRSk+1 outputted from a k+1th driving stage, and provides the second discharge voltage VSS2 to the first node NQ in response to a switching signal outputted from the second control unit 300.

The first control unit 200 includes a transistor TR2-1 (hereinafter referred to as a first control transistor) for outputting the carry signal CRSk−1 to the first node NQ. The carry signal CRSk−1 is outputted to the first node NQ before the kth gate signal GSk is outputted.

FIG. 6B is a view illustrating a horizontal period HPk (hereinafter referred to as a kth horizontal period) where a kth gate signal GSk is outputted, an immediately previous horizontal period HPk−1 (hereinafter referred to as a k−1th horizontal period), and an immediately next (e.g., after) horizontal period HPk+1 (hereinafter referred to as an k+1th horizontal period), from among a plurality of horizontal periods.

The first control transistor TR2-1 includes a control electrode and an input electrode, which commonly receive the k−1th carry signal CRSk−1. The first control transistor TR2-1 includes an output electrode connected to the first node NQ.

The first control unit 200 further includes control transistors TR2-21 and TR2-22 in a first group, and control transistors TR2-31 and TR2-32 in a second group. The control transistors TR2-21 and TR2-22 in the first group and the control transistors TR2-31 and TR2-32 in the second group deactivate the output unit 100.

The control transistors TR2-21 and TR2-22 in the first group are connected in series between the second voltage input terminal V2 and the first node NQ. The control transistors TR2-31 and TR2-32 in the second group are connected in series between the second voltage input terminal V2 and the first node NQ. A configuration of the first control unit 200 is not limited to the above described configuration, and one of the groups of the control transistors TR2-21 and TR2-22 in the first group and the control transistors TR2-31 and TR2-32 in the second group may be omitted or variously changed.

The first group of control transistors TR2-21 and TR2-22 includes a second control transistor TR2-21 (including a control electrode connected to the control terminal CT, an input electrode for receiving the second discharge voltage VSS2, and an output electrode), and a third control transistor TR2-22 (including a control electrode connected to the control terminal CT, an input electrode connected to the output electrode of the second control transistor TR2-21, and an output electrode connected to the first node NQ). A node connected to the output electrode of the second control transistor TR2-21 and the input electrode of the third control transistor TR2-22 is referred to as a first intermediate node NM1.

The second group of control transistors TR2-31 and TR2-32 includes a fourth control transistor TR2-31 (including a control electrode connected to the second node NA, an input electrode for receiving the second discharge voltage VSS2, and an output electrode), and a fifth control transistor TR2-32 (including a control electrode connected to the second node NA, an input electrode connected to the output electrode of the fourth control transistor TR2-31, and an output electrode connected to the first node NQ). A node connected to the output electrode of the fourth control transistor TR2-31 and the input electrode of the fifth control transistor TR2-32 is referred to as a second intermediate node NM2.

One of output signals GSk and CRSk may be applied to each of the first intermediate node NM1 and the second intermediate node NM2. In the present embodiment, the output signal may be the kth carry signal CRSk. As the kth carry signal CRSk is applied to each of the first intermediate node NM1 and the second intermediate node NM2, a voltage level of the first node NQ may be maintained or substantially maintained at greater than a set or predetermined value. This will be described in more detail later.

The first control unit 200 includes a capacitor CAP for boosting a voltage of the first node NQ. The capacitor CAP is connected between the output electrode of the first output transistor TR1-1 and the control electrode (or the first node NQ) of the first output transistor TR1-1.

As shown in FIG. 6B, a voltage of the first node NQ is raised to a first high voltage VQ1 by an operation of the first control transistor TR2-1 during the k−1th horizontal period HPk−1. When the k−1th carry signal CRSk−1 is applied to the first node NQ, the capacitor CAP is charged with a voltage corresponding thereto. During the kth horizontal period HPk, the first high voltage VQ1 is boosted to a second high voltage VQ2, and the kth gate signal GSk is outputted.

During the k+1th horizontal period HPk+1 and subsequent periods, a voltage of the first node NQ is dropped to the second discharge voltage VSS2 by operations of the first group of control transistors TR2-21 and TR2-22 and the second group of control transistors TR2-31 and TR2-32. During the k+1th horizontal period HPk+1, the first group of control transistors TR2-21 and TR2-22 are turned on in response to the k+1th carry signal CRSk+1 to provide the second discharge voltage VSS2 to the first node NQ, and during subsequent periods after the k+1th horizontal period HPk+1, the second group of control transistors TR2-31 and TR2-32 are turned on in response to a switching signal to provide the second discharge voltage VSS2 to the first node NQ.

Until the kth gate signal GSk in the next frame period of the k+1th horizontal period HPk+1 is outputted, a voltage of the first node NQ is maintained or substantially maintained at the second discharge voltage VSS2. Accordingly, until the kth gate signal GSk in the next frame period of the k+1th horizontal period HPk+1 is outputted, the first output transistor TR1-1 and the second output transistor TR1-2 are maintained or substantially maintained in an off state.

Referring to FIGS. 6A and 6B, the second control unit 300 outputs a switching signal to the second node NA. The switching signal is a signal having a phase of the second node NA shown in FIG. 6B.

The second control unit 300 may include at least one output inverter transistor for outputting the first clock signal CKV to the second node NA, and at least one pull-down inverter transistor for pulling down a voltage of the second node NA during a period where the kth gate signal GSk is outputted.

In the present embodiment, the output inverter transistor may include first and second inverter transistors TR3-1 and TR3-2. The first inverter transistor TR3-1 includes an input electrode and a control electrode connected commonly to the clock terminal CK, and an output electrode connected to a control electrode of the second inverter transistor TR3-2. The second inverter transistor TR3-2 includes the control electrode connected to the output electrode of the first inverter transistor TR3-1, an input electrode connected to the clock terminal CK, and an output electrode connected to the second node NA.

In the present embodiment, the pull-down inverter transistor may include third and fourth inverter transistors TR3-3 and TR3-4. The third inverter transistor TR3-3 includes an output electrode connected to the output electrode of the first inverter transistor TR3-1, a control electrode connected to the carry terminal CR, and an input electrode connected to the second voltage input terminal V2. The fourth inverter transistor TR3-4 includes an output electrode connected to the second node NA, a control electrode connected to the carry terminal CR, and an input electrode connected to the second voltage input terminal V2. However, the inventive concept is not limited thereto, and according to an embodiment of the inventive concept, the control electrodes of the third and fourth inverter transistors TR3-3 and TR3-4 may be connected to the output terminal OUT, and the output electrodes of the third and fourth inverter transistors TR3-3 and TR3-4 may be connected to the first voltage input terminal V1.

As shown in FIG. 6B, the second node NA has a high period and a low period, which correspond to a high period and a low period of the first clock signal CKV, except for during the kth horizontal period HPk. During the kth horizontal period HPk, the third and fourth inverter transistors TR3-3 and TR3-4 are turned on in response to the kth carry signal CRSk. At this time, a high voltage VH-C of the first clock signal CKV outputted from the second inverter transistor TR3-2 is discharged to the second discharge voltage VSS2. During periods other than the kth horizontal period HPk, a high voltage VH-C and a low voltage VL-C of the first clock signal CKV outputted from the second inverter transistor TR3-2 are provided to the second node NA.

Referring to FIGS. 6A and 6B, the first pull-down unit 400 includes a first pull-down transistor TR4-1 and a second pull-down transistor TR4-2. One of the first pull-down transistor TR4-1 and the second pull-down transistor TR4-2 may be omitted.

The first pull-down transistor TR4-1 includes an input electrode connected to the first voltage input terminal V1, a control electrode connected to the control terminal CT, and an output electrode connected to the output terminal OUT. The second pull-down transistor TR4-2 includes an input electrode connected to the first voltage input terminal V1, a control electrode connected to the second node NA, and an output electrode connected to the output terminal OUT. However, the inventive concept is not limited thereto, and according to an embodiment of the inventive concept, at least one of the input electrode of the first pull-down transistor TR4-1 and the input electrode of the second pull-down transistor TR4-2 may be connected to the second voltage input terminal V2.

A voltage of the kth gate signal GSk after the k+1th horizontal period HPk+1 corresponds to a voltage of the output terminal OUT. During the k+1th horizontal period HPk+1, the first pull-down transistor TR4-1 provides the first discharge voltage VSS1 to the output terminal OUT in response to the k+1th carry signal CRSk+1. After the k+1th horizontal period HPk+1, the second pull-down transistor TR4-2 provides the first discharge voltage VSS1 to the output terminal OUT in response to a switching signal outputted from the second node NA.

Referring to FIGS. 6A and 6B, the second pull-down unit 500 includes a third pull-down transistor TR5-1 and a fourth pull-down transistor TR5-2. The third pull-down transistor TR5-1 includes an input electrode connected to the second voltage input terminal V2, a control electrode connected to the control terminal CT, and an output electrode connected to the carry terminal CR. The fourth pull-down transistor TR5-2 includes an input electrode connected to the second voltage input terminal V2, a control electrode connected to the second node NA, and an output electrode connected to the carry terminal CR. However, the inventive concept is not limited thereto, and according to an embodiment of the inventive concept, at least one of the input electrode of the third pull-down transistor TR5-1 and the input electrode of the fourth pull-down transistor TR5-2 may be connected to the first voltage input terminal V1.

A voltage of the kth carry signal CRSk after the k+1th horizontal period HPk+1 corresponds to a voltage of the carry terminal CR. During the k+1th horizontal period HPk+1, the third pull-down transistor TR5-1 provides the second discharge voltage VSS2 to the carry terminal CR in response to the k+1th carry signal CRSk+1. After the k+1th horizontal period HPk+1, the fourth pull-down transistor TR5-2 provides the second discharge voltage VSS2 to the carry terminal CR in response to a switching signal outputted from the second node NA.

Figure 7A:
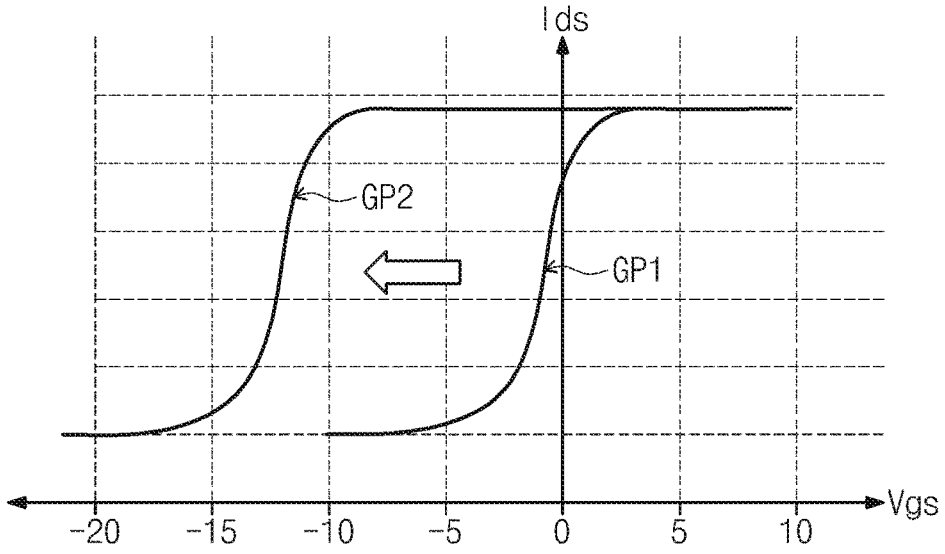
FIG. 7A is a graph illustrating a voltage-current relationship of a transistor.
Figure 7B:
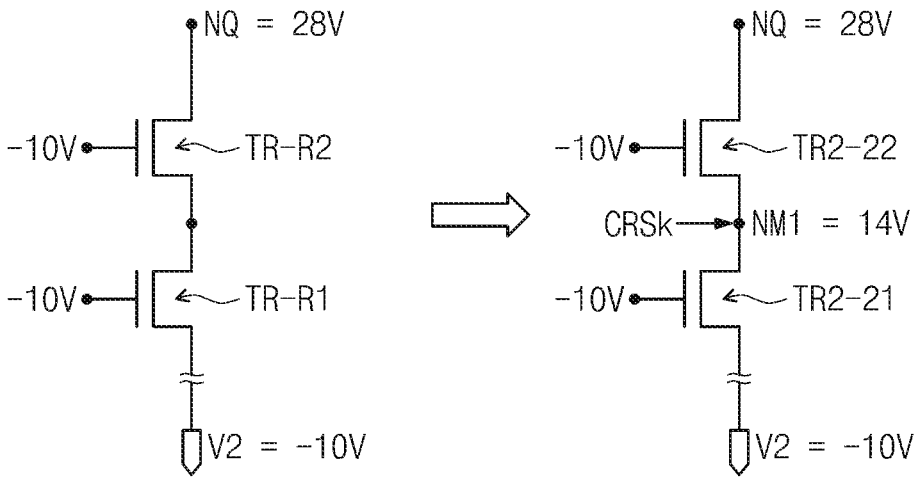
FIG. 7B is a view illustrating voltages of electrodes in a transistor.
Figure 7C:
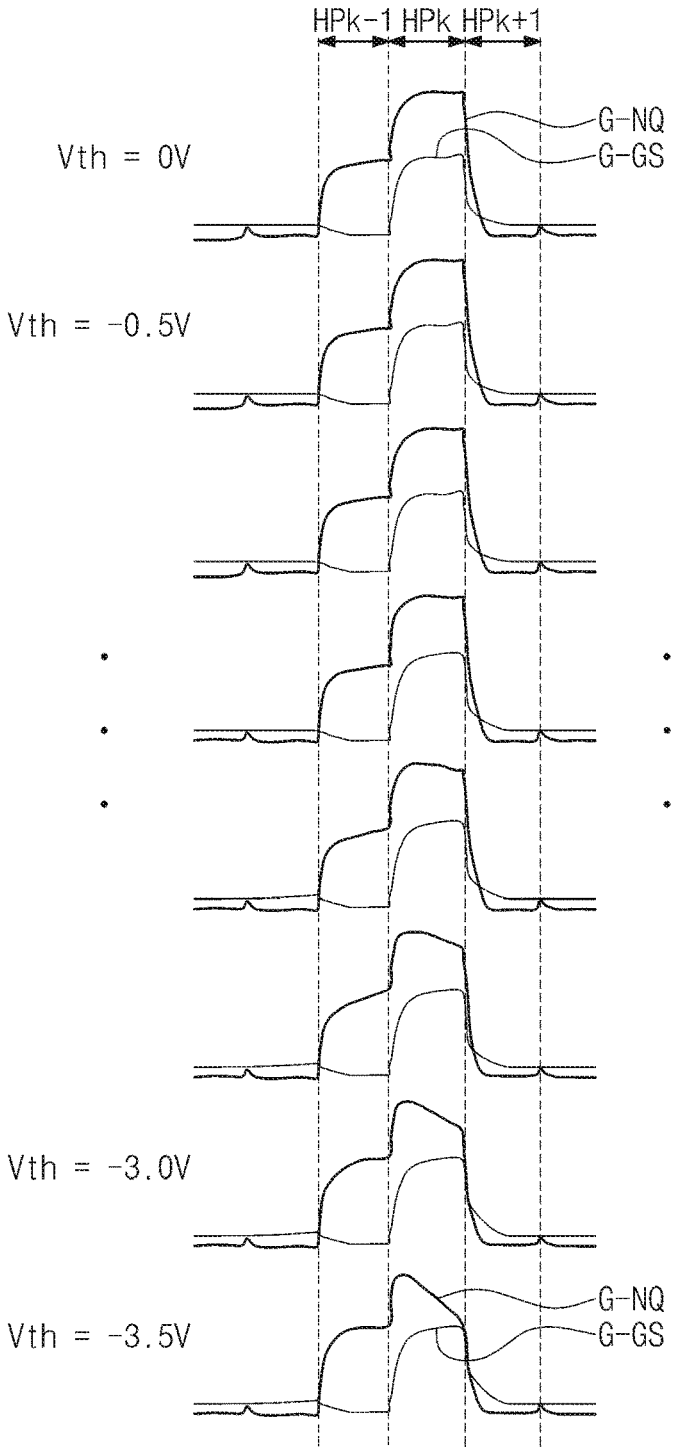
FIGS. 7C-7D are signal waveform diagrams of driving stages according to a simulation result.
Figure 7D:
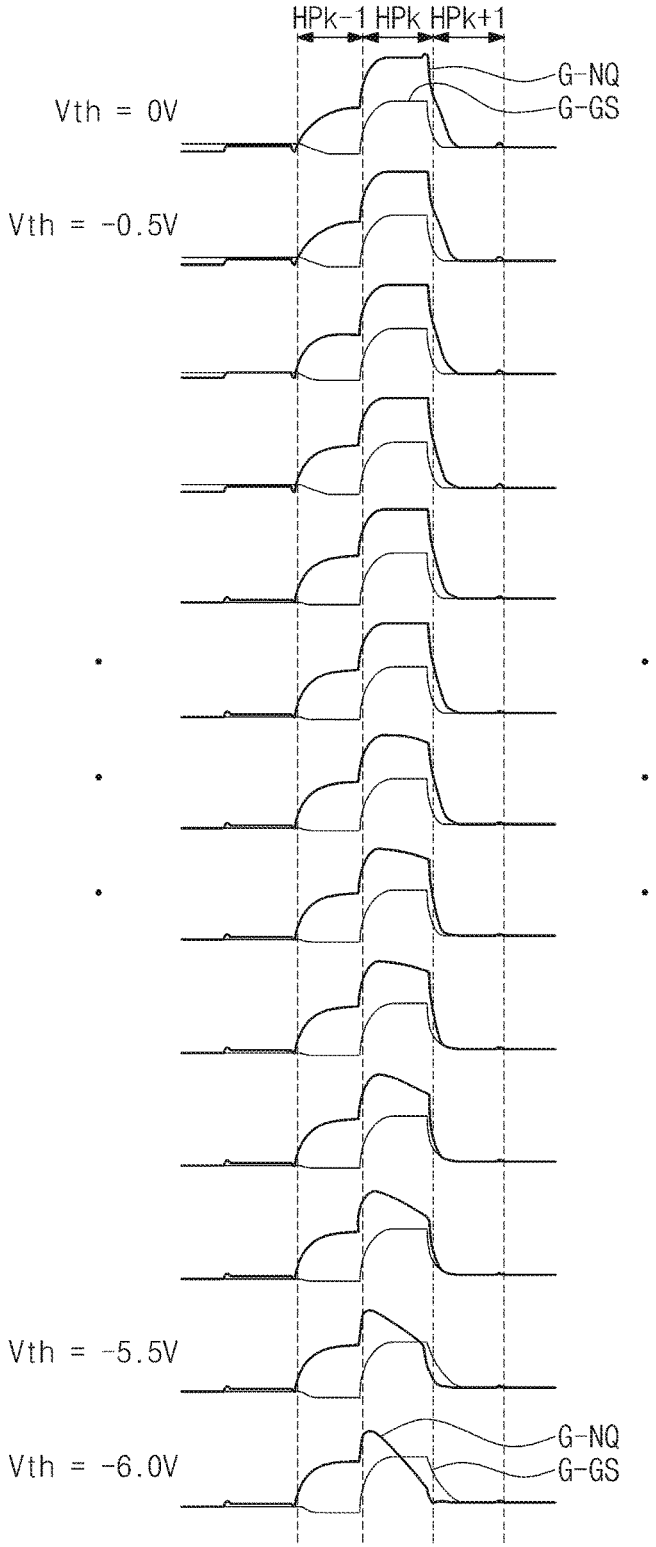

FIG. 7A is a graph illustrating a voltage-current relationship of a transistor. FIG. 7B is a view illustrating voltages of electrodes in a transistor. FIGS. 7C and 7D are signal waveform diagrams of driving stages according to a simulation result.

FIG. 7A illustrates a voltage-current relationship of a transistor (hereinafter, a metal oxide transistor) including a metal oxide semiconductor layer. The X-axis represents a voltage difference (hereinafter referred to as a gate-source voltage) between a control electrode and an input electrode of a transistor, and the Y-axis represents a current intensity. Transistors described with reference to FIGS. 6A and 6B may be metal oxide transistors. The metal oxide transistors are designed to have voltage-current characteristics as shown in a first graph GP1, but may have voltage-current characteristics as shown in a second graph GP2 due to the influences of processes for manufacturing a display panel. That is, the metal oxide transistor may have negative shifted voltage-current characteristics in comparison to designed values.

A transistor having voltage-current characteristics as shown in the second graph GP2 may have a greater leakage current in a negative gate-source voltage Vgs in comparison to a transistor having voltage-current characteristics as shown in the first graph GP1. That is, when a transistor is turned off, a malfunction may occur (that is, a current path may be formed).

According to the present embodiment, even with negative shifted voltage-current in comparison to designed values, a voltage of the first node NQ may be maintained or substantially maintained at a greater level than a reference value. As described in more detail later, this is because the gate-source voltage Vgs of the third control transistor TR2-22 is changed when the carry signal CRSk is applied to the first intermediate node NM1.

FIG. 7B illustrates a comparison between first group of control transistors TR-R1 and TR-R2 according to a comparative example and the first group of control transistors TR2-21 and TR2-22 according to the present embodiment. In the present embodiment, it is assumed, for example, that the first discharge voltage VSS1 is about −7 V, the second discharge voltage VSS2 is about −10 V, and the high voltage VH-C (see FIG. 6B) of the first clock signal CKV is about 14 V.

Referring to FIGS. 6A and 6B, during the kth horizontal period HPk, the gate-source voltage Vgs of each of the first group of control transistors TR-R1 and TR-R2 according to the comparative example is about 0 V. If each of the first group of control transistors TR-R1 and TR-R2 according to the comparative example has voltage-current characteristics as shown in the second graph GP2 of FIG. 7A, leakage current occurs between the first node NQ and the first voltage input terminal V1. Accordingly, during the kth horizontal period HPk, the first node NQ may not maintain a voltage level of greater than a reference value.

In comparison, during the kth horizontal period HPk, the gate-source voltage Vgs of the third control transistor TR2-

22 according to the present embodiment is about −24 V. Even if each of the first group of control transistors TR2-21 and TR2-22 according to the present embodiment has voltage-current characteristics as shown in the second graph GP2 of FIG. 7A, leakage current between the first node NQ and the first voltage input terminal V1 may be prevented or reduced by the third control transistor TR2-22.

FIG. 7C illustrates a Q node voltage G-NQ and a gate signal G-GS of the kth driving stage SRCk including the first group of control transistors TR-R1 and TR-R2 according to the comparative example. FIG. 7D illustrates a Q node voltage G-NQ and a gate signal G-GS of the kth driving stage SRCk including the first group control of transistors TR2-21 and TR2-22 according to the present embodiment.

Referring to FIG. 7C, when the threshold voltage Vth of the first group of control transistors TR-R1 and TR-R2 is set to about −3.5 V, a normal operation is provided, but when the threshold voltage Vth is set to a value less than about −3.5 V, an abnormal operation is provided. Referring to FIG. 7D, until the threshold voltage Vth of the first group of control transistors TR2-21 and TR2-22 is set to about −6.0 V, a normal operation is provided. A driving stage according to the present embodiment may have a broader shift range of the voltage-current characteristics of normally-operating transistors in comparison to a driving stage according to the comparative example.

Figure 8:
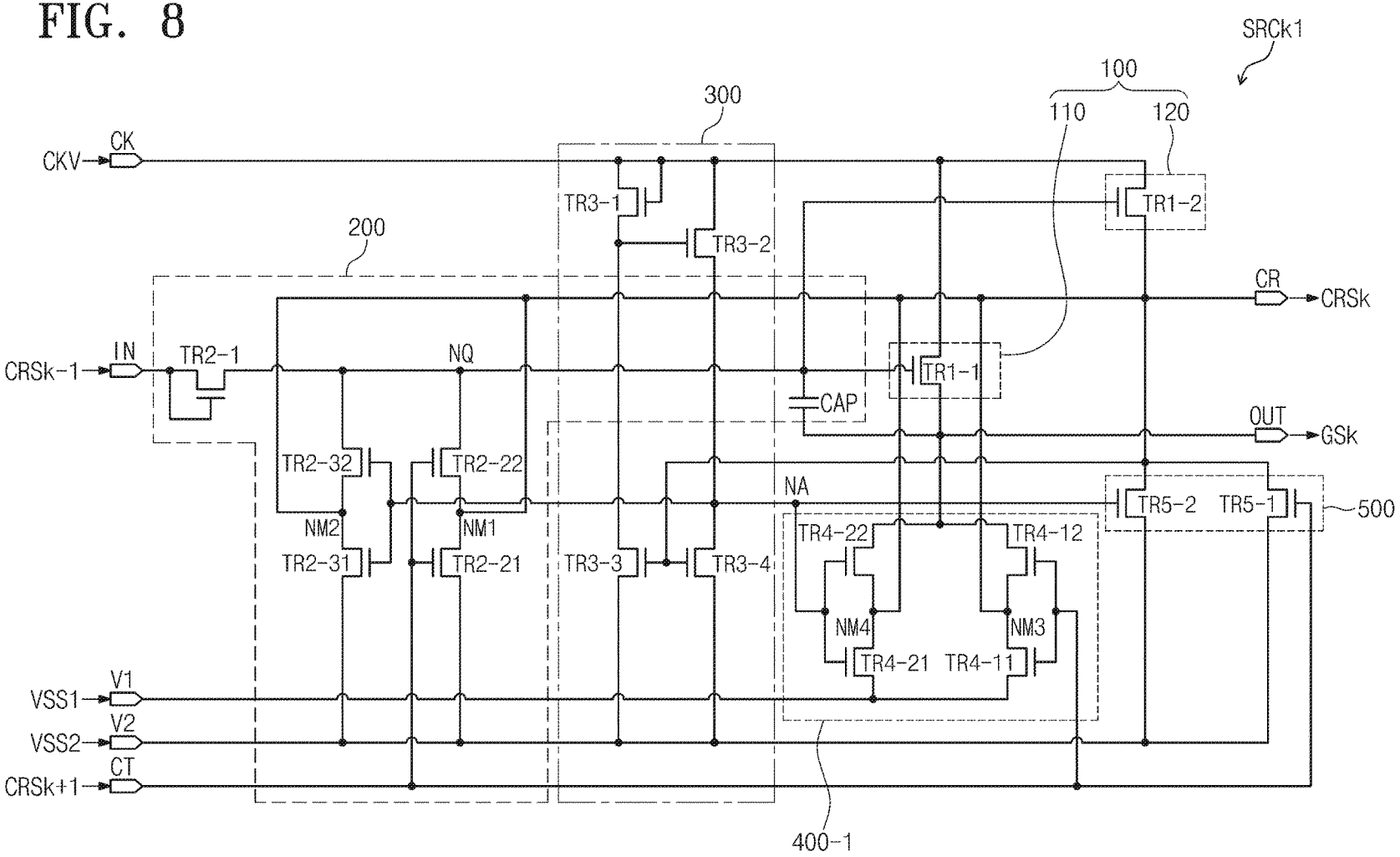
FIG. 8 is a circuit diagram of a driving stage according to an embodiment of the inventive concept.

FIG. 8 is a circuit diagram of a driving stage SRCk1 according to an embodiment of the inventive concept. Hereinafter, the driving stage SRCk1 is described with reference to FIG. 8. However, detailed descriptions for components that are the same or substantially the same as those described with reference to FIGS. 1 through 7D are not repeated.

The driving stage SRCk1 shown in FIG. 8 and the driving stage SRCk shown in FIG. 6A have the same or substantially the same configuration, except for the first pull-down unit 400 and 400-1. According to the embodiment of FIG. 8, the first pull-down unit 400-1 includes a first group of pull-down transistors TR4-11 and TR4-12 and a second group of pull-down transistors TR4-21 and TR4-22.

The first group of pull-down transistors TR4-11 and TR4-12 includes a first transistor TR4-11 and a second transistor TR4-12. The first transistor TR4-11 and the second transistor TR4-12 are connected in series between the first voltage input terminal V1 and the output terminal OUT.

The first transistor TR4-11 includes an input electrode connected to the first voltage input terminal V1, a control electrode connected to the control terminal CT, and an output electrode. The second transistor TR4-12 includes an input electrode connected to the output electrode of the first transistor TR4-11, a control electrode connected to the control terminal CT, and an output electrode connected to the output terminal OUT. A node connected to the output electrode of the first transistor TR4-11 and the input electrode of the second transistor TR4-12 is referred to as a third intermediate node NM3.

The second group of pull-down transistors TR4-21 and TR4-22 includes a third transistor TR4-21 and a fourth transistor TR4-22. The third transistor TR4-21 and the fourth transistor TR4-22 are connected in series between the first voltage input terminal V1 and the output terminal OUT.

The third transistor TR4-21 includes an input electrode connected to the first voltage input terminal V1, a control electrode connected to the second node NA, and an output electrode. The fourth transistor TR4-22 includes an input electrode connected to the output electrode of the third transistor TR4-21, a control electrode connected to the second node NA, and an output electrode connected to the output terminal OUT. A node connected to the output electrode of the third transistor TR4-21 and the input electrode of the fourth transistor TR4-22 is referred to as a fourth intermediate node NM4.

One of output signals GSk and CRSk may be applied to each of the third intermediate node NM3 and the fourth intermediate node NM4. In the present embodiment, the output signal may be a kth carry signal CRSk. As the kth carry signal CRSk is applied to each of the third intermediate node NM3 and the fourth intermediate node NM4, leakage current may not occur from the first pull-down unit 400-1 during the kth horizontal period HPk (e.g., see FIG. 6B). Accordingly, a level of the kth gate signal GSk may be maintained or substantially maintained at a value greater than a reference value.

Figure 9:
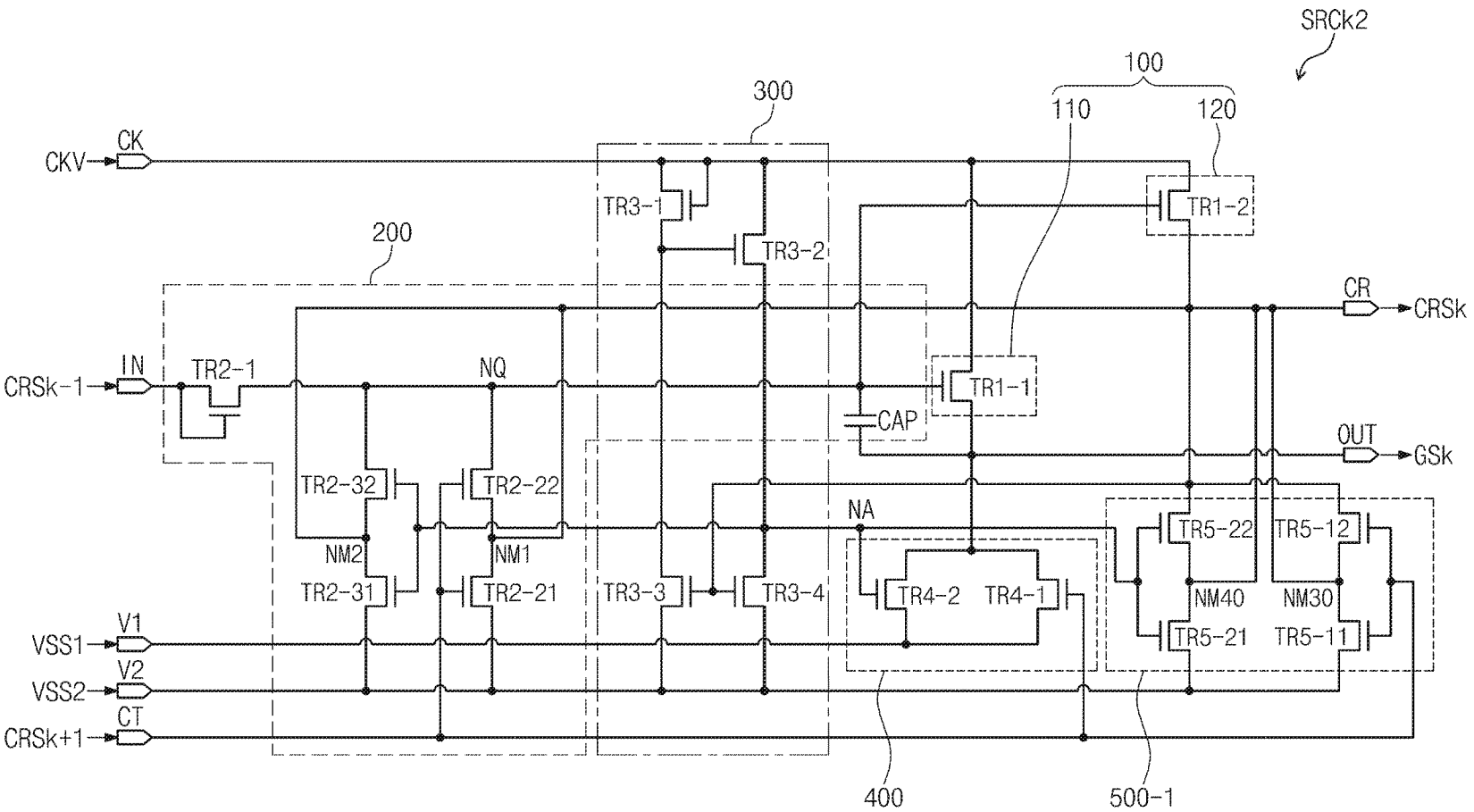
FIG. 9 is a circuit diagram of a driving stage according to an embodiment of the inventive concept.

FIG. 9 is a circuit diagram of a driving stage SRCk2 according to an embodiment of the inventive concept. Hereinafter, the driving stage SRCk2 is described with reference to FIG. 9. However, detailed descriptions for components that are the same or substantially the same as those described with reference to FIGS. 1 through 7D are not repeated.

The driving stage SRCk2 shown in FIG. 9 and the driving stage SRCk shown in FIG. 6A have the same or substantially the same configuration, except for the second pull-down unit 500 and 500-1. According to the embodiment of FIG. 9, the second pull-down unit 500-1 includes a first group of pull-down transistors TR5-11 and TR5-12 and a second group of pull-down transistors TR5-21 and TR5-22.

The first group of pull-down transistors TR5-11 and TR5-12 includes a first transistor TR5-11 and a second transistor TR5-12. The first transistor TR5-11 and the second transistor TR5-12 are connected in series between the second voltage input terminal V2 and the carry terminal CR The first transistor TR5-11 includes an input electrode connected to the second voltage input terminal V2, a control electrode connected to the control terminal CT, and an output electrode. The second transistor TR5-12 includes an input electrode connected to the output electrode of the first transistor TR5-11, a control electrode connected to the control terminal CT, and an output electrode connected to the carry terminal CR. A node connected to the output electrode of the first transistor TR5-11 and the input electrode of the second transistor TR5-12 is referred to as a third intermediate node NM30.

The second group of pull-down transistors TR5-21 and TR5-22 include a third transistor TR5-21 and a fourth transistor TR5-22. The third transistor TR5-21 and the fourth transistor TR5-22 are connected in series between the second voltage input terminal V2 and the carry terminal CR The third transistor TR5-21 includes an input electrode connected to the second voltage input terminal V2, a control electrode connected to the second node NA, and an output electrode. The fourth transistor TR5-22 includes an input electrode connected to the output electrode of the third transistor TR5-21, a control electrode connected to the second node NA, and an output electrode connected to the carry terminal CR. A node connected to the output electrode of the third transistor TR4-21 and the input electrode of the fourth transistor TR4-22 is referred to as a fourth intermediate node NM40.

One of output signals GSk and CRSk may be applied to each of the third intermediate node NM30 and the fourth intermediate node NM40. In the present embodiment, the output signal may be a kth carry signal CRSk. As the kth carry signal CRSk is applied to each of the third intermediate node NM30 and the fourth intermediate node NM40, leakage current may not occur from the second pull-down unit 500-1 during the kth horizontal period HPk (see FIG. 6B). Accordingly, a level of the kth gate signal GSk may be maintained or substantially maintained at a value greater than a reference value.

According to an embodiment of the inventive concept, the first pull-down unit 400 of FIG. 9 may be replaced with the first pull-down unit 400-1 shown in FIG. 8.

Figure 10:
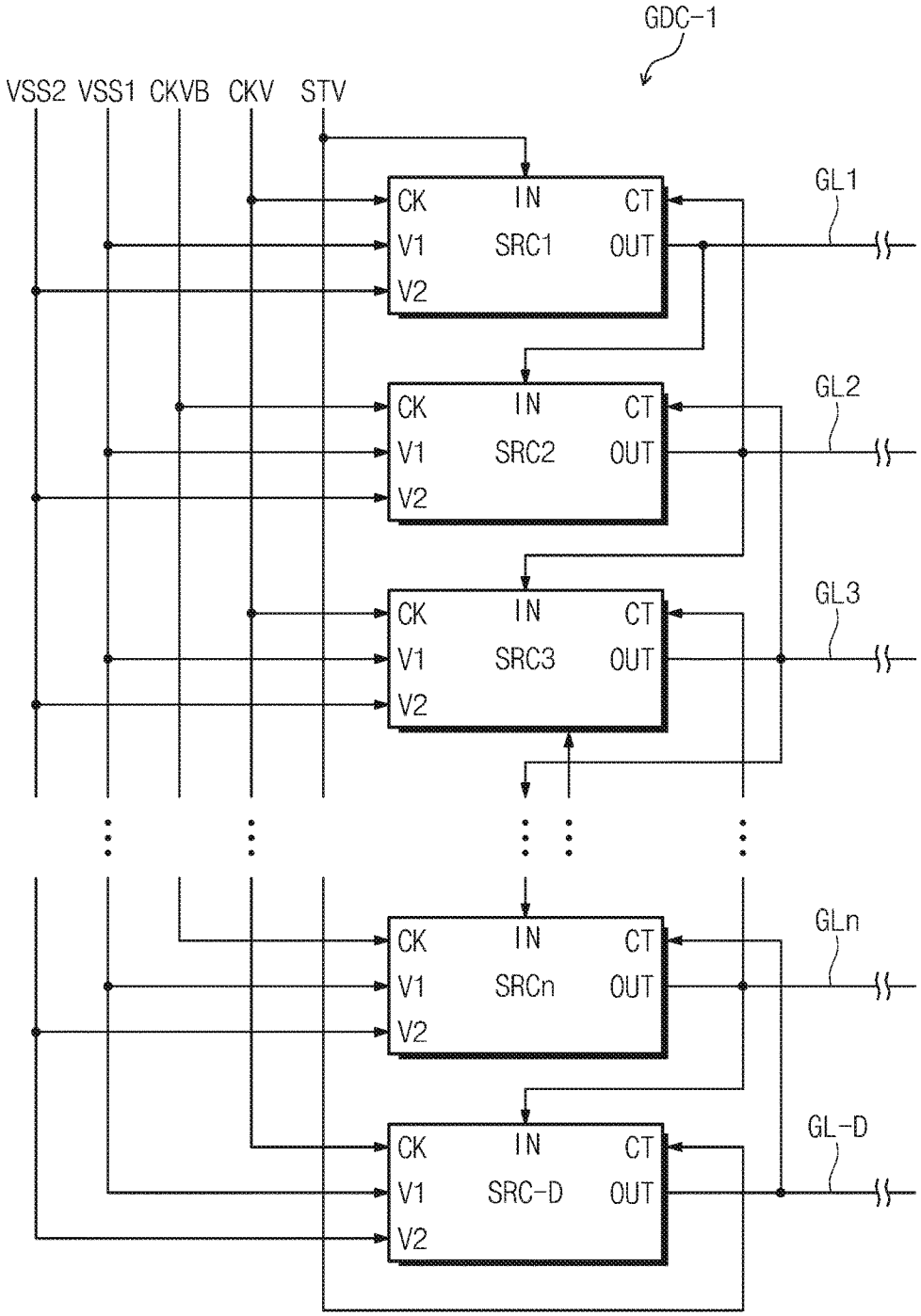
FIG. 10 is a block diagram illustrating a gate driving circuit according to an embodiment of the inventive concept.
Figure 11:
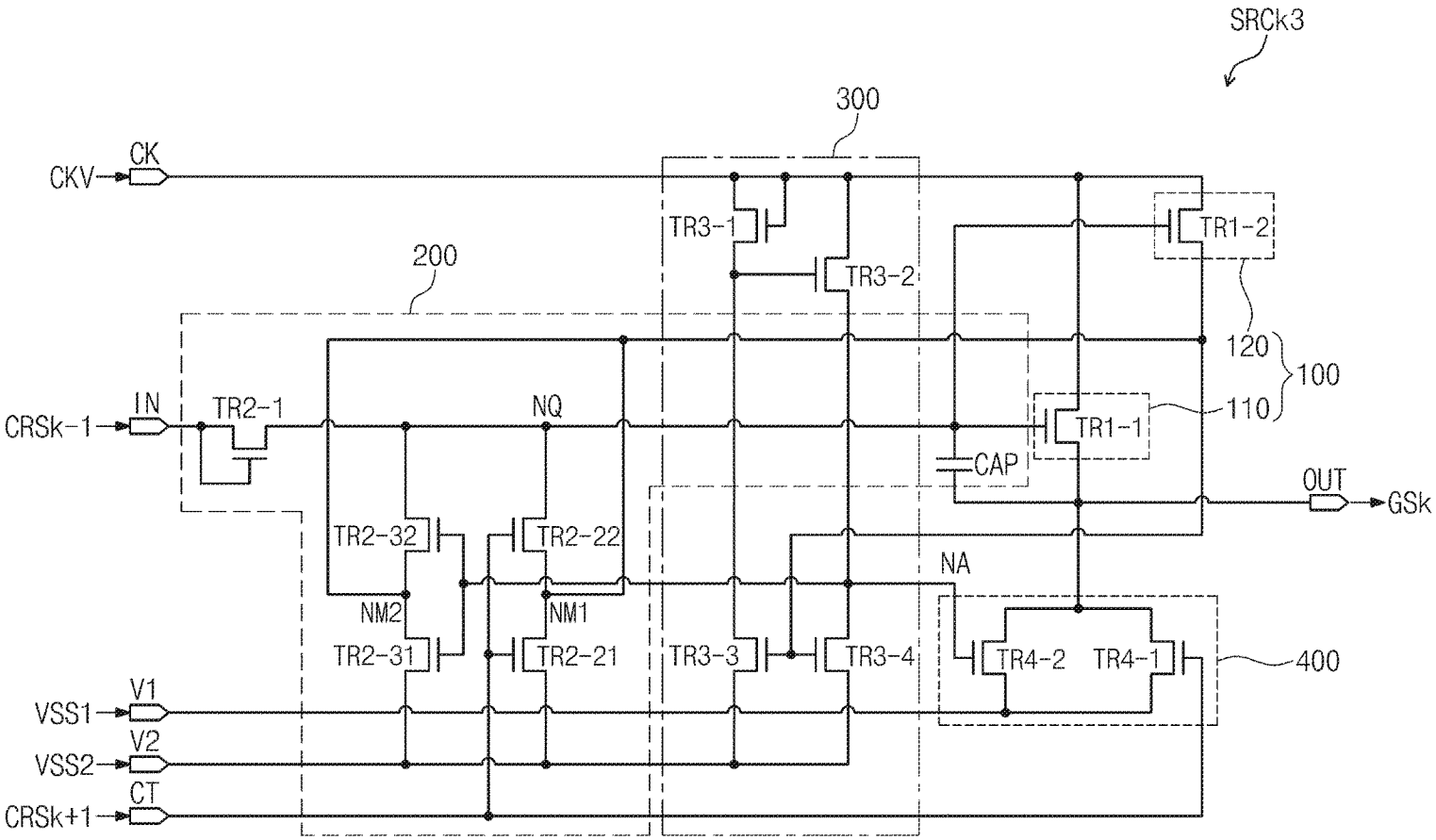
FIG. 11 is a circuit diagram of a driving stage according to an embodiment of the inventive concept.

FIG. 10 is a block diagram illustrating a gate driving circuit GDC-1 according to an embodiment of the inventive concept. FIG. 11 is a circuit diagram of a driving stage SRCk3 according to an embodiment of the inventive concept. Hereinafter, the gate driving circuit GDC-1 according to the embodiment of FIG. 10 is described with reference to FIGS. 10 and 11. However, detailed descriptions for components that are the same or substantially the same as those described with reference to FIGS. 1 through 7D are not repeated.

The gate driving circuit GDC-1 according the present embodiment includes a plurality of driving stages SRC1 to SRCn connected in cascade to each other. The plurality of driving stages SRC1 to SRCn are respectively connected to the plurality of gate lines GL1 to GLn. The gate driving circuit GDC-1 may further include a dummy stage SRC-D connected to a last driving stage SRCn from among the plurality of driving stages SRC1 to SRCn. The dummy stage SRC-D may be connected to the dummy gate line GL-D.

Each of the plurality of driving stages SRC1 to SRCn includes an output terminal OUT, an input terminal IN, a control terminal CT, a clock terminal CK, a first voltage input terminal V1, and a second voltage input terminal V2. Here, the carry terminal CR is omitted in comparison to the driving stages SRC1 to SRCn shown in FIG. 5.

The output terminal OUT of each of the plurality of driving stages SRC1 to SRCn is electrically connected to the input terminal IN of the next driving stage of a corresponding driving stage. For example, the input terminal IN of the third driving stage SRC3 may receive the gate signal of the second driving stage SRC2 that is an immediately previous driving stage. The input terminal IN of the first driving stage SRC1 receives the start signal STV.

The control terminal CT of each of the plurality of driving stages SRC1 to SRCn is electrically connected to the output terminal OUT of the next driving stage of a corresponding driving stage. The control terminal CT of each of the plurality of driving stages SRC1 to SRCn receives the gate signal of the next driving stage of a corresponding driving stage. For example, the control terminal CT of the second driving stage SRC2 may receive a gate signal outputted from the output terminal OUT of the third driving stage SRC3 that is the immediately next driving stage.

FIG. 11 illustrates a kth driving stage SRCk3 from among n driving stages SRC1 to SRCn shown in FIG. 10. The kth driving stage SRCk3 includes an output unit 100, a first control unit 200, a second control unit 300, and a pull-down unit 400. In relation to the kth driving stage SRCk3 of FIG. 11, the second pull-down unit 500 is omitted in comparison to the kth driving stage SRCk shown in FIG. 6A.

Additionally, the second output unit 120 does not output the kth carry signal CRSk (see FIG. 6A). The second output unit 120 outputs a control signal. The second output unit 120 provides a buffer signal to each of the first intermediate node NM1 and the second intermediate node NM2 during the kth horizontal period HPk, and provides a switching signal to each of the third and fourth inverter transistors TR3-3 and TR3-4.

Figure 12:
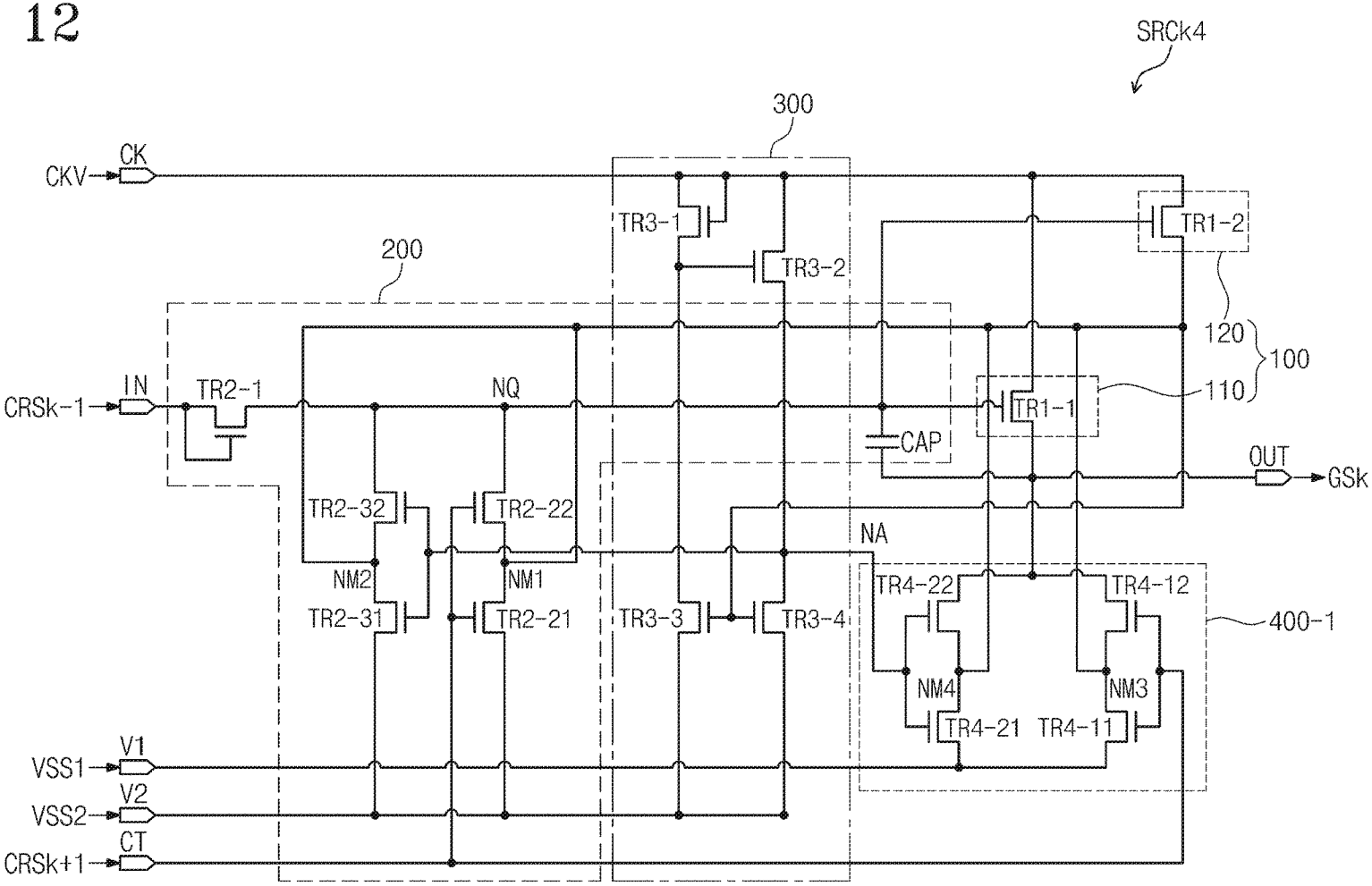
FIG. 12 is a circuit diagram of a driving stage according to an embodiment of the inventive concept.

FIG. 12 is a circuit diagram of a driving stage SRCk4 according to an embodiment of the inventive concept. According to the embodiment of FIG. 12, the driving stage SRCk4 may include the driving stage SRCk3 shown in FIG. 11 and the pull-down unit 400-1 may include a first group of pull-down transistors TR4-11 and TR4-12 and a second group of pull-down transistors TR4-21 and TR4-22 as shown in the pull-down unit 400-1 described with reference to FIG. 8.

As described above, as an output signal is applied to an intermediate node of transistors connected in series between a first node and a discharge voltage input terminal, a voltage of the first node is maintained or substantially maintained at a level greater than a reference value, so that leakage current occurring from transistors connected in series is reduced. Accordingly, the output of an output signal is not delayed.

Furthermore, as an output signal is applied to an intermediate node of transistors connected in series between an output terminal and a discharge voltage input terminal, the output of the output signal may not be delayed, and the output signal may have a high level greater than a reference value.

The electronic or electric devices and/or any other relevant devices or components according to embodiments of the inventive concept described herein may be implemented utilizing any suitable hardware, firmware (e.g. an application-specific integrated circuit), software, or a combination of software, firmware, and hardware. For example, the various components of these devices may be formed on one integrated circuit (IC) chip or on separate IC chips. Further, the various components of these devices may be implemented on a flexible printed circuit film, a tape carrier package (TCP), a printed circuit board (PCB), or formed on one substrate. Further, the various components of these devices may be a process or thread, running on one or more processors, in one or more computing devices, executing computer program instructions and interacting with other system components for performing the various functionalities described herein. The computer program instructions are stored in a memory which may be implemented in a computing device using a standard memory device, such as, for example, a random access memory (RAM). The computer program instructions may also be stored in other non-transitory computer readable media such as, for example, a CD-ROM, flash drive, or the like. Also, a person of skill in the art should recognize that the functionality of various computing devices may be combined or integrated into a single computing device, or the functionality of a particular computing device may be distributed across one or more other computing devices without departing from the spirit and scope of the exemplary embodiments of the inventive concept.

Although exemplary embodiments of the present invention have been described, it is understood that the present invention should not be limited to these exemplary embodiments, and that various changes and modifications may be made by one having ordinary skill in the art within the spirit and scope of the present invention as defined in the following claims, and their equivalents.

What is claimed is:

1. A display device comprising:

a display panel comprising a plurality of gate lines; and a gate driving circuit comprising a plurality of driving stages configured to output a plurality of gate signals to the gate lines, a kth driving stage from among the plurality of driving stages for outputting a kth gate signal from among the plurality of gate signals, where k is a natural number of two or more, the kth driving stage comprising:

at least one output transistor comprising a control electrode connected to a first node, an input electrode configured to receive a clock signal, and an output electrode configured to output an output signal;

a first control transistor configured to output an activation signal to turn on the at least one output transistor to the first node before the kth gate signal is outputted;

a capacitor configured to boost a voltage of the first node after the activation signal is provided to the first node; and second and third control transistors connected in series between the first node and a voltage input terminal configured to receive a discharge voltage, wherein a first intermediate node between the second control transistor and the third control transistor is configured to directly receive the output signal.

2. The display device of claim 1, wherein:

the at least one output transistor comprises a first output transistor configured to output the kth gate signal, and a second output transistor configured to output a kth carry signal synchronized with the kth gate signal; and the first intermediate node is configured to receive one of the kth gate signal and the kth carry signal as the output signal.

3. The display device of claim 2, wherein the capacitor is connected between an output electrode of the first output transistor and a control electrode of the first output transistor.

4. The display device of claim 1, wherein the second and third control transistors are configured to be turned on in response to a k+1th output signal outputted from a k+1th driving stage from among the driving stages.

5. The display device of claim 1, wherein the activation signal is a k−1th output signal outputted from a k−1th driving stage from among the driving stages.

6. The display device of claim 5, further comprising fourth and fifth control transistors connected in series between the first node and the voltage input terminal, the fourth and fifth control transistors being configured to be turned on during a period different from the second and third control transistors, wherein a second intermediate node between the fourth control transistor and the fifth control transistor is configured to receive the output signal.

7. The display device of claim 6, further comprising inverter transistors configured to provide a switching signal to a second node connected to control electrodes of the fourth and fifth control transistors, wherein the inverter transistors comprise:

at least one output inverter transistor configured to output the clock signal to the second node; and at least one pull-down inverter transistor configured to pull down a voltage of the second node during a period when the kth gate signal is outputted.

8. The display device of claim 1, further comprising a pull-down transistor configured to provide the discharge voltage to the output electrode of the at least one output transistor after the kth gate signal is outputted.

9. A display device comprising:

a display panel comprising a plurality of gate lines; and a gate driving circuit comprising a plurality of driving stages electrically connected to the gate lines, respectively, a kth driving stage, where k is a natural number of two or more, from among the driving stages comprising:

an output unit configured to generate a kth output signal based on a clock signal, and to output the kth output signal to an output terminal in response to a voltage of a first node;

a first control unit configured to control the voltage of the first node;

a second control unit configured to output a switching signal to a second node, the switching signal being generated based on the clock signal; and a pull-down unit configured to pull down a voltage of the output terminal after the kth output signal is outputted, wherein the first control unit comprises:

a first control transistor configured to provide an activation signal for activating the output unit to the first node before the kth output signal is outputted; and second and third control transistors connected in series between the first node and a first voltage input terminal configured to receive a first discharge voltage, and wherein the kth output signal is to be directly provided to a first intermediate node between the second control transistor and the third control transistor.

10. The display device of claim 9, wherein the kth output signal comprises a kth gate signal and a kth carry signal, and the output terminal comprises a first output terminal and a second output terminal, and wherein the output unit comprises:

a first output transistor comprising a control electrode connected to the first node, an input electrode configured to receive the clock signal, and an output electrode configured to output the kth gate signal to the first output terminal;

a second output transistor comprising a control electrode connected to the first node, an input electrode configured to receive the clock signal, and an output electrode configured to output the kth carry signal to the second output terminal; and a capacitor connected between the output electrode of the first output transistor and the control electrode of the first output transistor.

11. The display device of claim 10, wherein the pull-down unit comprises:

a first pull-down unit configured to pull down the first output terminal after the kth gate signal is outputted; and a second pull-down unit configured to pull down the second output terminal after the kth carry signal is outputted.

12. The display device of claim 11, wherein the first pull-down unit comprises first and second pull-down transistors connected in series between the first output terminal and a second voltage input terminal configured to receive a second discharge voltage having a different level than that of the first discharge voltage; and the kth output signal is to be provided to a second intermediate node between the first pull-down transistor and the second pull-down transistor.

13. The display device of claim 12, wherein the first pull-down unit further comprises third and fourth pull-down transistors connected in series between the first output terminal and the second voltage input terminal, the third and fourth pull-down transistors being configured to be turned on in a different period from a period when the first and second pull-down transistors are turned on; and the kth output signal is to be provided to a third intermediate node between the third pull-down transistor and the fourth pull-down transistor.

14. The display device of claim 11, wherein the second pull-down unit comprises first and second pull-down transistors connected in series between the first output terminal and the first voltage input terminal; and the kth output signal is to be provided to a second intermediate node between the first pull-down transistor and the second pull-down transistor.

15. The display device of claim 14, wherein the second pull-down unit further comprises third and fourth pull-down transistors connected in series between the first output terminal and the first voltage input terminal, the third and fourth pull-down transistors being configured to be turned on in a different period from a period when the first and second pull-down transistors are turned on; and the kth output signal is to be provided to a third intermediate node between the third pull-down transistor and the fourth pull-down transistor.

16. The display device of claim 9, wherein the second and third control transistors are configured to be turned on in response to a k+1th output signal outputted from a k+1th driving stage from among the driving stages.

17. The display device of claim 16, wherein the activation signal is a k−1th output signal outputted from a k−1th driving stage.

18. The display device of claim 17, wherein the first control unit further comprises fourth and fifth control transistors connected in series between the first node and the first voltage input terminal and configured to be turned on in a different period from a period when the second and third control transistors are turned on; and the kth output signal is to be provided to a second intermediate node between the fourth control transistor and the fifth transistor.

19. The display device of claim 18, wherein the fourth and fifth control transistors are configured to be turned on by the switching signal after the kth output signal is outputted.

20. A display device comprising:

a display panel comprising a plurality of gate lines; and a gate driving circuit comprising a plurality of driving stages electrically connected to the gate lines, respectively, a kth driving stage, where k is a natural number of two or more, from among the driving stages comprising:

an output unit configured to generate a kth output signal based on a clock signal, and to output the kth output signal to an output terminal in response to a voltage of a first node;

a first control unit configured to control the voltage of the first node;

a second control unit configured to output a switching signal to a second node, the switching signal being generated based on the clock signal; and a pull-down unit configured to pull down a voltage of the output terminal after the kth output signal is outputted, wherein the pull-down unit comprises:

a first pull-down unit configured to pull down the first output terminal after the kth gate signal is outputted; and a second pull-down unit configured to pull down the second output terminal after the kth carry signal is outputted;

wherein the first control unit comprises:

a first control transistor configured to provide an activation signal for activating the output unit to the first node before the kth output signal is outputted; and second and third control transistors connected in series between the first node and a first voltage input terminal configured to receive a first discharge voltage, wherein the kth output signal is to be provided to a first intermediate node between the second control transistor and the third control transistor, wherein the kth output signal comprises a kth gate signal and a kth carry signal, and the output terminal comprises a first output terminal and a second output terminal, and wherein the output unit comprises:

a first output transistor comprising a control electrode connected to the first node, an input electrode configured to receive the clock signal, and an output electrode configured to output the kth gate signal to the first output terminal;

a second output transistor comprising a control electrode connected to the first node, an input electrode configured to receive the clock signal, and an output electrode configured to output the kth carry signal to the second output terminal; and a capacitor connected between the output electrode of the first output transistor and the control electrode of the first output transistor, and wherein, the first pull-down unit comprises first and second pull-down transistors connected in series between the first output terminal and a second voltage input terminal configured to receive a second discharge voltage having a different level than that of the first discharge voltage, and the kth output signal is to be provided to a second intermediate node between the first pull-down transistor and the second pull-down transistor.

* * * * *